US005109246A

United States Patent [19]

Yamamoto et al.

[11] Patent Number: 5,109,246

[45] Date of Patent: Apr. 28, 1992

[54] APPARATUS FOR PROCESSING LIGHT-SENSITIVE MATERIALS

[75] Inventors: Soichiro Yamamoto; Hiroshi Hayashi, both of Kanagawa, Japan

[73] Assignee: Fuji Photo Film Co., Ltd., Kanagawa, Japan

[21] Appl. No.: 631,700

[22] Filed: Dec. 19, 1990

[30] Foreign Application Priority Data

Dec. 19, 1989 [JP] Japan ..... 1-327243
Nov. 8, 1990 [JP] Japan ..... 2-301140

[51] Int. Cl.[5] ..... G03D 5/00
[52] U.S. Cl. ..... 354/318
[58] Field of Search ..... 354/318, 324, 329, 330, 354/314-323; 355/28, 29, 27

[56] References Cited

FOREIGN PATENT DOCUMENTS 62-240967 10/1987 Japan .
62-240969 10/1987 Japan .
63-216050 9/1988 Japan .

*Primary Examiner*—L. T. Hix
*Assistant Examiner*—D. Rutledge
*Attorney, Agent, or Firm*—Sughrue, Mion, Zinn, Macpeak & Seas

[57] ABSTRACT

An apparatus for processing a light-sensitive material that has a roller that is partly submerged in a processing solution and that picks up said processing solution to supply said processing solution onto the light-sensitive material being transported above said processing solution. The roller is rotated at a peripheral speed at least 1.5 times the absolute value of the transport speed of said light-sensitive material.

25 Claims, 8 Drawing Sheets

APPARATUS FOR PROCESSING LIGHT-SENSITIVE MATERIALS

BACKGROUND OF THE INVENTION

The present invention relates to an apparatus for processing light-sensitive materials. More particularly, the present invention relates to an apparatus that is capable of rapid and high-quality processing of light-sensitive materials in a consistent manner.

Apparatus are available in which exposed light-sensitive materials are subjected to various treatments including development, bleaching, fixing, bleach-fixing, washing with water, stabilization and drying, whereby an image is formed on the processed light-sensitive materials. Among the post-exposure steps mentioned above, the steps of washing with water and stabilization are sometimes collectively referred to as "cleaning steps." The post-exposure treatments are usually performed by a process in which the exposed light-sensitive material being transported is successively immersed in the associated processing solutions.

One of the objectives of recent research and development efforts in the photographic industry is to process all kinds of light-sensitive materials in a simpler and more rapid way. However, if the conventional apparatus which allow exposed light-sensitive materials to be immersed in processing solutions are simplified and made compact, the proportion of the overall processing time occupied by the immersion times is decreased, to thereby reduce the effective processing period.

With a view to overcoming this disadvantage, various non-immersion systems have been proposed for use in the cleaning apparatus (or the apparatus for washing with water). JP-A-62-0967 (the term "JP-A" as used herein means an "unexamined published Japanese patent application") and JP-A-62-240969 describe apparatus for cleaning the surface of light-sensitive materials under running water, and JU-A-50-947 (the term "JU-A" as used herein means an "unexamined published Japanese utility model application") and JU-A-51-147442 describe apparatus for washing with cleaning water that is sprayed over light-sensitive materials.

However, those treatments are not perfectly adapted for rapid processing. The probable reason is that the processing solution present on the surface of a light-sensitive material cannot be smoothly replaced by a fresh supply of the same processing solution. Apparatus having a transport path in each processing tank also are not preferred since transport and other devices that must be installed within the processing tanks inevitably increase the overall size of the equipment.

Consider, for example, the step of washing with water. If a light-sensitive material having a bleach-fixing solution deposited thereon is immediately dried, the components in the bleach-fixing solution such as thiosulfates and silver complex salts of thiosulfates will crystallize on the surface of the dried light-sensitive material or react with image silver during storage to cause a color change or fading in the image. Further, the silver complex salt dissolved in the blix solution will convert to contaminant silver sulfide. Hence, the light-sensitive material is washed with water and stabilized in order to remove those unwanted components from the surface of the light-sensitive material or from within the emulsion film.

If washing is to be done by immersing the light-sensitive material in washing water, a transport system is necessary for transporting the light-sensitive material through a washing tank accommodating a large volume of washing water into which the material can be immersed. This increases not only the complexity of the transport mechanism, but also the size of the overall system. Further, the need to immerse the light-sensitive material in washing water for a predetermined time results in prolonged washing.

JP-A-63-216050 describes an apparatus in which a light-sensitive material is immersed in washing water in a washing tank in slit form. This apparatus is capable of efficient washing with a small volume of water but, on the other hand, the system is complex and involves difficult maintenance.

The apparatus described in JP-A-62-240967 and JP-A-62-240969 in which the surface of a light-sensitive material is washed under running water have the disadvantage that the use of running water along is insufficient to achieve satisfactory washing. JP-A-62-240970 describes an apparatus that permits running water to be supplied in a plurality of stages, but this system is bulky and complex and involves difficult maintenance. The apparatus described in JU-A-50--947 and JU-A-51-147442 in which a light-sensitive material is washed with a water jet also have the disadvantage that the used of a water jet along is insufficient to achieve satisfactory washing.

SUMMARY OF THE INVENTION

As will be apparent from the foregoing description, the principal object of the present invention is to provide an apparatus with which light-sensitive materials can be processed very rapidly in a manner that is simple and that will not cause deterioration in the quality of processed light-sensitive materials.

As a result of intensive studies, the present inventors found that the above-stated object could be attained by any one of the apparatuses described below under (1)–(4):

(1) an apparatus for processing a light-sensitive material that has a roller that is partly submerged in a processing solution and that picks up the processing solution to be supplied onto the light-sensitive material being transported above the processing solution, the roller being rotatable at a peripheral speed at least 1.5 times the absolute value of the transport speed of the light-sensitive material;

(2) an apparatus as in (1), wherein the processing solution is a cleaning solution;

(3) an apparatus as in (1) or (2), wherein the absolute value of the rotational speed of the roller is at least 60 times the absolute value of the transport speed of the light-sensitive material; and (4) an apparatus as in any one of (1) to (3), wherein the space above the processing solution is substantially airtight.

In accordance with the present invention, the roller capable of picking up a processing solution of interest is used to supply the processing solution onto the surface of a light-sensitive material being transported, and this roller is caused to rotate at a peripheral speed greater than the absolute value of the transport speed of the light-sensitive material. As a result, the processing solution is rapidly replaced by a fresh supply of the same solution on the surface of the light-sensitive material so as to insure its efficient processing.

To take the cleaning step as an example, the components of the processing solution used in the previous step which have been deposited on the surface of the light-sensitive material are removed by means of a fresh supply of cleaning water that rapidly replaces the fouled cleaning water so as to accomplish efficient cleaning. In the developing step, the developing solution in contact with the emulsion-coated surface of the light-sensitive material is rapidly replaced by a fresh developing solution, thereby achieving rapid and efficient development.

Thus, the present invention enables cleaning, developing and other photographic processing steps to be performed rapidly. Further, the invention enables rapid processing with small amounts of processing solutions. In addition, the use of a smaller number of machine components contributes to the construction of a simple and compact apparatus which features easy maintenance.

The roller used in the present invention to pick up processing solutions may be placed in substantial contact with light-sensitive materials. Alternatively, the roller may be disposed in such a way that it is not in contact with the light-sensitive material when it is not processed but contacts the light-sensitive material in a processing mode via the processing solution it picks up.

The expression that "the roller is partly submerged in a processing solution" means that the surface of the processing solution traverses the roller when it becomes stationary after the processor is shut down.

The roller may be rotatable in the same direction as the light-sensitive material is transported; alternatively, it may rotate in the direction opposite to the transport of the light-sensitive material. The latter generally achieves better results in processing since processing solutions on the light-sensitive material can be replaced more rapidly with fresh solutions.

If the roller rotates in the same direction as the light-sensitive material is transported, it may have the capability of transporting the material. If the roller rotates in the direction opposite to the transport of the light-sensitive material, transport rollers or other transport devices must be provided separately.

Processing solutions picked up by the roller form a "liquid puddle" between the light-sensitive material and the roller. When the roller rotates in the same direction as the transport of the light-sensitive material, the processing solution will form an increased amount of such "liquid puddle" in an area downstream of the transport of the light-sensitive material. This liquid puddle will stay on the surface of the light-sensitive material and tends to move with the latter, thereby making it difficult to remove the processing solution from the processed light-sensitive material in an efficient way.

When the roller rotates in the direction opposite to the transport of the light-sensitive material, a liquid puddle that forms in an area upstream of the transport of the material will be subjected to two forces, one acting in the direction of the transport and the other acting in opposite direction. Since the roller rotates at a speed much faster than the transport of the light-sensitive material, the liquid puddle tends to move in the direction in which the roller rotates. Hence, processing solutions can be replaced by fresh ones very efficiently and, further, they are removed from the surface of the light-sensitive material in an efficient way.

For the reasons stated above, the roller is preferably rotated in the direction opposite to the transport of the light-sensitive material in order to insure rapid replacement of processing solutions supplied to the surface of the light-sensitive material.

Another characterizing feature of the present invention is that the roller for picking up processing solutions rotate at a peripheral speed greater than absolute value of the transport speed of the light-sensitive material.

In coating emulsions and other fluids onto light-sensitive materials, it is known that rollers are rotated in contact with both the fluid and light-sensitive material. Such rollers are mostly driven to rotate at a peripheral speed that is substantially the same as the transport speed of the light-sensitive material, the surface of the light-sensitive material may be damaged or other problems can occur, such as the failure to maintain high precision of coating. Hence, no one has yet succeeded in operating coating systems with rollers being rotated at a faster peripheral speed than the transport of light-sensitive materials.

In fact, however, the practice of the present invention revealed that the surface of light-sensitive materials was not damaged at all even, when the materials were not processed with the pickup roller being rotated at faster speeds than transport of the light-sensitive materials. This is believed to occur because a film of processing solution is formed between the pickup roller and the light-sensitive material, and further because the processing solution is subjected to continuous and fast replacement (liquid flow).

Therefore, rotating the pickup roller at high peripheral speed is also important from the viewpoint of liquid replacement. This is an entirely new approach that cannot be conceived by merely extending the concept of the conventional coating methods.

In accordance with the invention, the absolute value of the peripheral speed of the pickup roller is at least 1.5 times the absolute value of the transport speed of the light-sensitive material. The present inventors have confirmed that the advantages of the present invention can be attained up to 1,500 times as fast as the transport speed of the light-sensitive material. The speed ratio is preferably 20–1,000, more preferably 30–500, and most preferably 60–300. The speed ratio as defined above can be increased to the extent that will not cause processing solutions to be atomized and splash over the light-sensitive material. The rotational speed of the pickup roller is set on the basis of this speed ratio and the transport speed of the light-sensitive material. In practice, it was verified that the advantages of the present invention could be attained up to a roller peripheral speed of 150 kg/h.

The shape of the surface of the pickup roller that can be used in the present invention and its material are not limited in any particular way.

Examples of the pickup roller include a roller that has grooves and ridges on the peripheral surface in order to make it possible for the roller to carry processing solutions, and a water-absorbing roller. From a practical viewpoint, the depth of grooves and the height of ridges on the peripheral surface of the roller are preferably in the range of 0.1–5 mm. A so-called "Meyer rod" having a wire wound in a spiral form may be used as the pickup roller, and the wire used in this case preferably has a diameter of 1–5 mm. Other rollers that can be used include a roller for gravure printing, a flat-faced roller and a sponge roller. Further, a roller equipped with blades, etc. for picking up processing solutions may be used.

In the practice of the present invention, the spaces above processing solutions are preferably made airtight in order to prevent evaporation and oxidation when processing solutions are supplied to the light-sensitive material by means of the pickup roller, the processing solutions have many chances to contact the air, whereupon evaporation or oxidation will proceed rapidly to reduce the processing capabilities of those solutions. Particularly in the step of washing with water in a system of rapid processing, the cleaning solution is in most cases held at high temperatures to insure rapid processing, which causes evaporation or oxidation to accelerate.

When cleaning is to be done by means of the pickup roller, the liquid level of the cleaning solution will drop rapidly if the liquid evaporates excessively, and the resulting failure to pick up the cleaning solution in an adequate amount causes not only insufficient cleaning but also damage to the surface of the light-sensitive material.

In order to avoid these problems, the space above processing solutions is preferably made substantially airtight. For the purpose of preventing the evaporation and oxidation of processing solutions, complete isolation of the processing solutions from air is preferred, but the space above these solutions need not be made completely airtight and making it substantially airtight will suffice.

One approach for making the space above processing solutions airtight is to provide a shield above processing solutions airtight is to provide a shield above the liquid surface of those processing solutions. When this method was put to practice it was found that the gap between the shield member above the liquid surface and the pickup roller was maintained at a sufficiently constant level to improve the consistency of processing by stabilizing the amount of processing solutions supplied to the roller.

In making the space above processing solutions airtight, it is important to make the inlets and outlets for the light-sensitive material airtight while reducing the degree of opening above the liquid surface. The term "substantially airtight" may be understood with reference to the disclosure in JP-A-Hei-2-84642 and it means, when expressed by a maximum slit width, a value of 1.5 mm for color developing, bleach-fixing, bleaching and stabilizing solutions, and 2.5 mm for a cleaning solution. The airtight apparatus may be filled with an inert gas such as nitrogen or argon gas.

When the present invention is to be applied to cleaning treatments, cleaning solutions that can be used include ion-exchanged water and tap water. These cleaning solutions may contain antiseptics, chelating agents, surfactants, Ph buffering agents, optical brightening agents, mold inhibitors, hardeners, etc.

Since light-sensitive materials are supplied with processing solutions only at the emulsion coated surface, subsequent drying can be easily accomplished.

When multi-stage cleaning is to be performed in the cleaning step with a plurality of cleaning tanks being provided, satisfactory results can be accomplished by applying the concept of the present invention to at least one of the tanks. Further, it is preferred to adopt a "countercurrent system" in multi-stage cleaning, in which the tank in the last stage is replenished with a cleaning solution which is successively transferred backward to a preceding tanks. The tank in the last stage is preferably replenished with the cleaning solution in an amount which is 0.5–3 times the volume of the cleaning solution carried in by the light-sensitive material from the preceding tank.

When the present invention is to be applied to a developing step, common developing solutions may be used unaltered. Probably because the developing solution near the surface of the light-sensitive material is rapidly replaced by a fresh developing solution, more rapid processing can be accomplished than in the case of development by immersion. Other advantages that were verified were not only reduced load on the drying process due to the need to process only the emulsion-coated surface of light-sensitive materials, but also consistent performance of continuous processing with smaller amounts of replenishers due to reduced amounts of liquid carryover into subsequent tanks.

Rapid processing and reduction in the drying load can also be realized when the present invention is applied to a bleach-fixing step. Further, the cleaning step can be simplified because the amount of carryover of bleaching agent and other components into the subsequent cleaning step is reduced.

The apparatus of the present invention can be used to process any kind of light-sensitive material that is to be processed with processing solutions, including, for example, black-and-white photographic materials for printing, medical and general purposes, as well as color photographic materials such as color negative films, color reversal films and color papers. The apparatus of the present invention is suitable for processing color prints by taking advantage of its capability for rapid processing, and it may be applied to the processing of intelligent color hard copies which particularly need to be processed rapidly.

When the present invention is applied to the processing of intelligent color hard copies, exposure is preferably performed by scanning with high-density light such as light from a laser (e.g. semiconductor laser) or a light-emitting diode.

The apparatus of the present invention exhibits a particularly effective cleaning action when it is used for very rapid cleaning of color photographic materials of the type described in the discussion of the preferred embodiments of the invention later in this specification and in the specification of Japanese Patent Application No. 232590/1989.

Halides that can be used in the light-sensitive materials to be processed by the present invention include, for example, silver chloride, silver bromide, silver (iodo)-chlorobromide and silver iodobromide. For the purpose of rapid processing silver chlorobromide emulsions that are substantially free of silver iodide and which have silver chloride contents of at least 90 mol%, preferably at least 95 mol%, more preferably at least 98 mol%, or silver chloride emulsions are preferably used. For such purposes as improving the sharpness of the image, the light-sensitive material to be processed by the present invention preferably contains in hydrophilic colloidal layers those dyes (particularly oxonole dyes) which can be decolored by processing and which are described on pages 27–76 of the specification of European Patent EP 0,337,490 A2, with those dyes being added in such amounts that the light-sensitive material will have an optical reflection density of at least 0.70 at 680 nm. The light-sensitive material may also contain in the water-resistant resin layer on the support at least 12 wt% (more preferably at least 14 wt%) of titanium oxide that is surface treated with dihydric to tetrahydric alcohols (e.g., trimethylolethane).

It is also preferred that compounds for improving the keeping quality of the color image as described in the specification of European Patent EP 0.277,589 A2 are used with couplers in the light-sensitive material to be processed to use such compounds in combination with pyrazoloazole couplers.

Compounds that bind chemically with aromatic amino color developing agents remaining after color development to produce chemically inert and substantially colorless compounds and/or compounds that bind chemically with the oxidation product of aromatic amino color developing agents remaining after color development to produce chemically inert and substantially colorless compounds are preferably used either independently or in combination for the purpose of preventing staining and other side effects caused by the formation of color dyes upon reaction between couplers and the residual color developing agents or oxidation product thereof during storage after processing.

It is also preferred that the light-sensitive material to be processed by the present invention have incorporated therein mold inhibitors of the type described in JP-A-63-271247 for the purpose of preventing various fungi and bacteria from growing in hydrophilic colloidal layers to cause image deterioration. For display purposes, white polyester-based supports or supports having a layer containing a white pigment on the side where a silver halide emulsion layer is formed may be used with the light-sensitive material that is to be processed by the present invention. For providing improved sharpness, an antihalo layer is preferably coated on the side of the support where a silver halide emulsion layer is coated, or on the opposite side. For permitting the display to be viewed under reflected or transmitted light, it is particularly preferred to set the transmission density of the support within the range of 0.35–0.8.

The light-sensitive material to be processed by the present invention may be exposed under visible or infrared light. Exposure may be continued for a long period at low intensity or for a short period at high intensity. In the latter case, exposure by scanning under laser light, with the exposure time being shorter than $10^{-4}$ seconds per pixel, is particularly preferred.

In exposure, a band-stop filter of the type described in U.S. Pat. No. 4,880,726 is preferably used. This eliminates the mixing of light colors, thereby achieving marked improvement in color reproduction.

Exposed light-sensitive materials may be subjected to color development but, for the purpose of rapid processing, a bleach-fixing treatment is preferably performed after color development. Particularly in the case of using the aforementioned emulsions of high silver chloride content, the pH of the bleach-fixing solution is preferably adjusted to about 6.5 or below, more preferably about 6 or below, for such purposes as accelerating the desilvering process.

For information on the silver halide emulsions and other components (e.g. additives) and the photographic constituent layers (including their arrangement) that are preferably used in the light-sensitive materials to be processed by the present invention, as well as the methods and additives that may be employed to process those light-sensitive materials, reference may be had to the following patent literature, especially the specification of European Patent EP 0,355,660 A2 (corresponding to Japanese Patent Application No. 107011/1989).

| Photographic constituent elements, etc. | JP-A-62-215272 | JP-A-Hei-2-3314 | EP 0,355,660 A2 |
|---|---|---|---|
| Silver halide emulsion | p. 10, upper right col., 1. 5, and p. 12, lower right col., 1. 4 from the bottom to p. 13, upper left col, 1. 17 | p. 28, upper right col, 1. 16, to p. 29, lower right col., 1. 11, and p. 30, 11. 2–5. | p. 45, 1. 53 - p. 47, 1. 3, and p. 47, 11. 20–22 |
| Silver halide emulsion | p. 12, lower left col., 1. 6–14 and p. 13, upper left col., 1. 3 from the bottom to p. 18, lower left col., last line | | |
| Chemical sensitizer | p. 12, lower left col., 1. 3 from the bottom lower right col., 1. 5 from the bottom and p. 18, lower right col., 1. 1 to p. 22, upper right col., 1. 9 from the bottom | p. 29, lower right col., 1. 12 to the last line | p. 47, 11. 4–9 |
| Spectral sensitizer (spectral sensitization) | p. 22, upper right col., 1. 8 from the bottom to p. 38, last line | p. 30, upper left col., 11. 1–13 | p. 47, 11. 10–15 |
| Emulsion stabilizer | p. 39, upper left col., 1. 1 to p. 27, upper right col., last line | p. 30, upper left col., 1. 14 to upper right col., 1. 1 | p. 47, 11. 16–19 |
| Development accelerator | p. 72, lower left col., 1. 1 to p. 91, upper right | | |

-continued

| Photographic constituent elements, etc. | JP-A-62-215272 | JP-A-Hei-2-3314 | EP 0,355,660 A2 |
|---|---|---|---|
| | col., 1. 3 | | |
| Color couplers (cyan, magenta and yellow couplers) | p. 91, upper right col., 1. 4 to p. 121, upper left col., 1. 6 | p. 3, upper right col., 1. 14 to p. 18, upper left col., last line and p. 30, upper right col., 1. 6 to p. 35, lower right col., 1. 11 | p. 4, 11. 15–27, p. 5, 1. 30 to p. 28, last line, p. 45, 11. 29–31, p. 47, 1. 23 to p. 63, 1. 50 |
| Color intensifier | p. 121, upper left col., 1. 7 to p. 125, upper right col., 1. 1 | | |
| UV absorber | p. 125, upper right col., 1. 2 to p. 127, lower left col., last line | p. 37, lower right col., 1. 14 to p. 38, upper left col., 1. 11 | p. 65, 11. 22–31 |
| Antifading agent (image stabilizer) | p. 127, lower right col., 1. 1 to p. 137, lower left col., 1. 8 | p. 36, upper right col., 1. 12 to p. 37, upper left col., 1. 19 | p. 4, 1. 30 to p. 5, 1. 23, p. 29, 1. 1 to p. 45, 1. 25, p. 45, 11. 33–40, p. 65, 11. 2–21 |
| High-boiling and/or low-boiling point organic solvent | p. 137, lower left co., 1. 9 to p. 144, upper right col., last line | p. 35, lower right co., 1. 14 to p. 36, upper left col., 1. 4 from the bottom | p. 64, 11. 1–51 |
| Method of dispersing photographic additives | p. 144, lower left col., 1. 1 to p. 146, upper right col., 1. 7 | p. 27, lower right col., 1. 10 to p. 28, upper left col., last line and p. 35, lower right col., 1. 12 to page 36, upper right col., 1. 7 | p. 63, 1. 51 to p. 64, 1. 56 |
| Hardener | p. 146, upper right col., 1. 8 to p. 155, lower left col., 1. 4 | | |
| Precursor of developing agent | p. 155, lower left col., 1. 5 to p. 155 lower right col., 1. 2 | | |
| Development restrainer releasing compound | p. 155, lower right col., 11. 3–9 | | |
| Support | p. 155, lower right col., 1. 19 to p. 156, upper left col., 1. 14 | p. 38, upper right col., 1. 18 to p. 39, upper left col., 1. 3 | p. 66, 1. 29 to p. 67, 1. 13 |
| Constitution of light-sensitive layers | p. 156, upper left col., 1. 15 to p. 156, lower right col., 1. 14 | p. 28, upper right col., 11. 1–15 | p. 45, 11. 41–52 |
| Dyes | p. 156, lower right col., 1. 15 to p. 184, lower right col., last line | p. 38, upper left col., 1. 12 to upper right col., 1. 7 | p. 66, 11. 18–22 |
| Anti-color mixing agent | p. 185, upper left col., 1. 1 to p. 188, lower right col., 1. 3 | p. 36, upper right col., 11. 8–11 | p. 64, 1. 57 to p. 65, 1. 1 |
| Contrast modifying agent | p. 188, lower right col., 11. 4–8 | | |
| Anti-stain agent | p. 188, lwer right col., 1. 9 to p. 193, lower right col., 1. 10 | p. 37, upper left col., last line to lower right col., 1. 13 | p. 65, 1. 32 to p. 66, 1. 17 |
| Surfactant | p. 201, lower left col., 1. 1 to p. 210, upper right col., last line | p. 18, upper right col., 1. 1 to p. 24, lower right col., last line and p. 27, | |

-continued

| Photographic constituent elements, etc. | JP-A-62-215272 | JP-A-Hei-2-3314 | EP 0.355,660 A2 |
|---|---|---|---|
| | | lower left col., 1. 10 from the bottom to lower right col., 1. 9 | |
| Fluorine-containing compounds (as antistatic, coating aid, lubricant, anti-blocking agent, etc.) | p. 210, lower left col., 1. 1 to p. 222, lower left col., 1. 5 | p. 25, upper left col., 1. 1 to p. 27, lower right col., 1. 9 | |
| Binder (hydrophilic binder) | p. 222, lower left col., 1. 6 to p. 225, upper left col., last line | p. 38, upper right col., 11. 8–18 | p. 66, 11. 23–28 |
| Thickener | p. 225, upper right col., 1. 1 to p. 227, upper right col., 1. 2 | | |
| Antistat | p. 227, upper right col., 1. 3 to p. 230, upper left col., 1. 1 | | |
| Polymer latex | p. 230, upper left col., 1. 2 to p. 239, last line | | |
| Matting agent | p. 240, upper left col., 1. 1 to p. 240, upper right col., last line | | |
| Method of photographic processing (e.g. processing steps and additives) | p. 3, upper right col., 1. 7 to p. 10, upper right col. 1. 5 | p. 39, upper left col., 1. 4 to p. 42, upper left col., last line | p. 67, 1. 14 to p. 69, 1. 28 |

Notes: The citations to JP-A-62-215272 include the amendments effected under date of March 16, 1987, and which are annexed at the end of the publication. Among the color couplers mentioned above, the yellow couplers may preferably be those "shifted to shorter wavelength in spectral absorption" as described in JP-A-63-231451, JP-A-63-123047, JP-A-63-241547, JP-A-Hei-1-173499, JP-A-Hei-213648 and JP-A-Hei-1-250944.

In addition to the diphenylimida-zole based cyan couplers described in JP-A-Hei-2-33144, the following couplers are preferably used as cyan couplers: the 3-hydroxypyridine based cyan couplers described in the specification of European Patent EP 0,333,185 A2 (among those, specifically mentioned coupler (42) which is converted from 4-equivalent to 2-equivalent type by incorporating a leaving Cl group, as well as couplers (6) and (9) are particularly preferred), and the cyclic active methylenic cyan couplers described in JP-A-64-3226C (among those, specifically mentioned couplers 3, 8 and 34 are particularly preferred).

The color photographic materials to be used in the present invention are preferably subjected to color development, bleach-fixing and washing with water (or stabilization). Bleaching and fixing may be performed either in a single bath or in separate baths.

The color developing solution to be used in the present invention contains known aromatic primary amino color developing agents. Preferred examples are p-phenylenediamine derivatives and typical, but by no means limiting, examples of such derivatives are listed below:

D-1 N,N-Diethyl-p-phenylenediamine
D-2 4-Amino-N,N-diethyl-3-methylaniline
D-3 4-Amino-N-(β-hydroxyethyl)-N-methylaniline
D-4 4-Amino-N-ethyl-N-(β-hydroxyethyl)aniline
D-5 4-Amino-N-ethyl-N-(β-hydroxyethyl)-3-methylaniline
D-6 4-Amino-N-ethyl-N-(3-hydroxypropyl)-3-methylaniline
D-7 4-Amino-N-ethyl-N-(4-hydroxybutyl)-3-methylaniline
D-8 4-Amino-N-ethyl-N-(β-methanesulfonamidoethyl)-3-methylaniline
D-9 4-Amino-N,N-diethyl-3-(β-hydroxyethyl)aniline
D-10 4-Amino-N-ethyl-N-(β-methoxyethyl)-3-methylaniline
D-11 4-Amino-N-(β-ethoxyethyl)-N-ethyl-3-methylaniline
D-12 4-Amino-N-(3-carbamoylpropyl)-N-n-propyl-3-methylaniline
D-13 4-Amino-N-(4-carbamoylbutyl)-N-n-propyl-3-methylaniline
D-14 N-(4-Amino-3-methylphenyl)-3-hydroxypyrrolidine
D-15 N-(4-Amino-3-methylphenyl)-3-(hydroxymethyl)pyrrolidine
D-16 N-(4-Amino-3-methylphenyl)-3-pyrrolidinecarboxamide.

Among the p-phenylenediamine derivatives listed above, illustrative compounds D-5, D-6, D-7, D-8 and D-12 are particularly preferred. These p-phenylenediamine derivatives may be in the form of such salts as sulfates, hydrochlorides, sulfites, naphthalene-disulfonates and p-toluenesulfonates. The aromatic primary amino developing agents are used in amounts that preferably range from 0.002 moles to 0.2 moles, more preferably from 0.005 moles to 0.1 moles, per liter of the developing solution.

In the practice of the present invention, developing solutions that are substantially free from benzyl alcohol are preferably used. The term "substantially free from benzyl alcohol" means that the developing solutions preferably have a benzyl alcohol concentration 2 ml/l or less, more preferably 0.5 ml/l or less. More preferably, the developing solutions contain no benzyl alcohol at all.

More preferably, the developing solution to be used in the present invention is substantially free of sulfite ions. Sulfite ions serve as a preservative for the developing agent but, at the same time, they dissolve silver halides and react with the oxidation product of the developing agent to reduce the efficiency of dye formation. These actions of sulfite ions are one of the causes of increasing the variations in photographic characteristics that accompany continuous processing. The term "substantially free of sulfite ions" as used herein means that the developing solution preferably contains sulfite ions at concentrations of no more than $3.0\times10^{-3}$ moles/l, and that most preferably it does not contain sulfite ions at all. It should, however, be noted that a very small amount of sulfite ions are used to prevent the oxidation of photochemical kits containing developing agents in a concentrated form before they are conditioned to tank solutions for use, and the aforementioned statement that they "developing solutions are preferably substantially free of sulfite ions" does not apply to such sulfite ions.

As already mentioned, the developing solutions for use in the present invention are preferably substantially free of sulfite ions. Further, it is preferred that such developing solutions also be substantially free of hydroxylamine. This is because hydroxylamines, which serve as a preservative for developing solutions, also have a silver developing activity by themselves and because variations in the concentration of hydroxylamines are considered to have substantial effects on photographic characteristics. The term "substantially free of hydroxylamine" as used herein means that the developing solution preferably contains hydroxylamine at concentrations of no more than $5.0\times10^{-3}$ moles/l, and that most preferably it does not contain hydroxylamine at all.

In a more preferred case, the developing solution for use in the present invention contains organic preservatives in place of hydroxylamine and sulfite ions.

The term "organic preservatives" as used herein pertains to a class of organic compounds which, when added to processing solutions for color photographic materials, will reduce the rate of deterioration of aromatic primary amino color developing agents. In other words, organic preservatives are organic compounds that have a capability for preventing aerial and otherwise oxidation of color developing agents. Particularly effective organic preservatives include hydroxylamine derivatives (excepting hydroxylamine, and this is also true in the following description), hydroxamic acids, hydrazines, hydrazides, phenols, γ-hydroxyketones, γ-aminoketones, saccharides, monoamines, diamines, polyamines, quaternary ammonium salts, nitroxy radicals, alcohols, oximes, diamide compounds, condensed cyclic amines, etc. These compounds are disclosed in various publications and specifications such as JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 3,494,903, JP-A-52-143020, and JP-B-48-30496 (the term "JP-B" as used herein means an "examined Japanese patent publication").

Other preservatives may be incorporated as required, including: the various metals described in JP-A-57-44148 and JP-A-57-53749; the salicylic acids described in JP-A-59-180588; the alkanolamines described in JP-A-54-3532; the polyethyleneimines described in JP-A-56-94349; and aromatic polyhydroxy compounds as described in U.S. Pat. No. 3,746,544. It is particularly preferred to add alkanolamines such as triethanolamine, dialkyl-hydroxylamines such as diethylhydroxylamine, as well as hydrazine derivatives and aromatic polyhydroxy compounds.

Among the organic preservatives described above, hydroxylamine derivatives and hydrazine derivatives (e.g., hydrazines and hydrazides) are particularly preferred. For further information, see JP-A-Hei-1-97953, JP-A-Hei-1-186939, JP-A-Hei-1-186940, JP-A-Hei-1-187557, etc.

The hydroxylamine or hydrazine derivatives described above may be used in combination with amines, and this is more preferred for the purpose of improving the stability of color developing solutions and, hence, for the purpose of improving the consistency of continuous processing.

The amines that can be used with those hydroxylamine or hydrazine derivatives include cyclic amines of the type described in JP-A-63-239447, amines of the type described in JP-A-63-128340, and amines of the type described in JP-A-Hei-1-186939 and JP-A-Hei-1-187557.

The color developing solution for use in the present invention preferably contains chloride ions in amounts of $3.5\times10^{-2}$ to $1.5\times10^{-1}$ moles/l, more preferably $4\times10^{-2}$ to $1\times10^{-1}$ moles/l. If the concentration of chloride ions is more than $1.5\times10^{-1}$ to $10^{-1}$ mole/l, development is retarded. This is not preferred for attaining the purposes of the present invention, i.e., achieving a maximum density in a rapid way. If the concentration of chloride ions is less than $3.5\times10^{-2}$ moles/l, fogging cannot be effectively prevented.

The color developing solution for use in the present invention preferably contains bromide ions in amounts of $3.0\times10^{-5}$ to $1.0\times10^{-3}$ moles/l, more preferably $5.0\times10^{-5}$ to $5\times10^{-4}$ moles/l. If the concentration of bromide ions is more than $1\times10^{-3}$ moles/l, development is retarded to reduce the maximum density and sensitivity that can be attained. If the concentration of bromide ions is less than $3.0\times10^{-5}$ moles/l, fogging cannot be effectively prevented.

Chloride and bromide ions may be directly added to the developing solution or, alternatively, they may be released from the light-sensitive material into the developing solution during development.

In the case of direct addition to the color developing solution, exemplary materials that serve as chloride ion suppliers include sodium chloride, potassium chloride, ammonium chloride, lithium chloride, nickel chloride, magnesium chloride, manganese chloride, calcium chloride and cadmium chloride, with sodium chloride and potassium chloride being preferred.

Chloride ions may be supplied from optical brightening agents incorporated in the developing solution.

Exemplary materials that serve as bromide ion suppliers include sodium bromide, potassium bromide, ammonium bromide, lithium bromide, calcium, bromide, magnesium bromide, manganese bromide, nickel bromide, cadmium bromide, cerium bromide and thallium bromide, with potassium bromide and sodium bromide being preferred.

In the case of release from the light-sensitive material during development, chloride or bromide ions may both be supplied from emulsions or, alternatively, they be supplied from other than emulsions.

The color developing solution for use in the present invention preferably has a pH of 9–12, more preferably 9–11.0. The color developing solution may also contain other compounds that are known to be used as components of developing solutions.

Various buffering agents are preferably used to maintain the pH of the color developing solution in the ranges set forth above. Useful buffering agents include carbonates, phosphates, borates, tetraborates, hydroxybenzoates, glycine salts, N,N-dimethylglycine salts, leucine salts, norleucine salts, guaine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. Among these compounds, carbonates, phosphates, tetraborates and hydroxybenzoates have high solubility, exhibit good buffering action in the high pH range (pH≧9.0), cause no adverse effects on photographic performance, even if they are present in the developing solution, and they are inexpensive. Because of these advantages, the four specific types of buffering agents mentioned above are used with particular preference.

Specific examples of those buffering agents include: sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). It should, however, be noted that the present invention is by no means limited to those compounds alone.

The buffering agents described above are preferably added to the color developing solution in amounts of at least 0.1 mole/l, with the range of 0.1–0.4 moles/l being particularly preferred.

Various chelating agents may be used in the color developing solution either as agents to prevent precipitation of calcium and magnesium, or for the purpose of improving the stability of the color developing solution. Exemplary chelating agents include: nitrilotriacetic acid, diethylenetriamine-pentaacetic acid, ethylenediaminetetraacetic acid, N,N,N-trimethylenephosphonic acid, ethylenediamine-N, N, N', N'- tetramethylenesulfonic acid, transcyclohexanediaminetetraacetic acid, 1,2-diaminopropanetetraacetic acid, glycolether-diaminetetraacetic acid, glycolether-diaminetetraacetic acid, 2-phosphonobutane-1,2,4-tricarboxylic acid, 1-hydroxyethylidene-1,1- diphosphonic acid, N, N'- bis (2-hydroxybenzyl)ethylenediamine-N,N,-diacetic acid, etc.

Depending on the need, these chelating agents may be used as admixtures. These chelating agents only need be added in amounts that are sufficient to sequester metal ions in the color developing solution, and the range of about 0.1–10 g per liter may be used as a guide.

If necessary, any development accelerator may be added to the color developing solution. Exemplary development accelerators that may be added as required include: thioether compounds as described in JP-B-37-16086, JP-B-37-5987, JP-B-38- 7826, JP-B-44-12380, JP-B-45-9019, U.S. Pat. No. 3,813,247, etc.; p-phenylenediamine compounds as described in JP-A-52-49829 and JP-A-50-15554; quaternary ammonium salts as described in JP-A-50-137726, JP-B-44-30074, JP-A-56-156826 and JP-A-52- 43429; amine compounds as described in U.S. Pat. Nos. 2,494,903, 3,128,182, 4,230,796, 3,253,919, JP-B-41-11431, U.S. Pat. Nos. 2,482,546, 2,596,926 and 3,582,346; polyalkylene oxides as described in JP-B-57-16088, JP-B-42-25201, U.S. Pat. No. 3,128,183, JP-B-41-11431, JP-B-42-23883 and U.S. Pat. No. 3,532,501; as well as 1-phenyl-3-pyrazolidones and imidazoles.

An antifoggant can also be added, as required, to the color developing solution for use in the present invention. Useful antifoggants include alkali metal halides (e.g., sodium chloride, potassium bromide and potassium iodide) and organic anti-foggants. Typical examples of organic antifoggants are nitrogenous heterocyclic compounds including benzotriazole, 6-nitrobenzimidazole, 5-nitroisoindazole, 5-methylbenzotraizole, 5-nitrobenzotriazole, 5-chloro-benzotriazole, 2-thiazolylbenzimidazole, 2-thiazolylmethyl-benzimidazole, indazole, hydroxyazaindolidine and adenine.

The color developing solution that can be used in the present invention preferably contains optical brightening agents. Preferred optical brightening agents are 4,4'-diamino-2,2'-disulfostilbene compounds. Optical brightening agents are added in amounts of 0–5 g/l, preferably 0.1–4 g/l.

Further, various surfactants such as alkysulfonic acids, arylsulfonic acids, aliphatic carboxylic acids and aromatic carboxylic acids may be added to the color developing solution as required.

Processing with the color developing solution that can be used in the present invention is performed at temperatures of 30°–50° C., preferably 35°–50° C. The processing time ranges from 5 to 30 seconds, preferably 5–20 seconds, more preferably 5–15 seconds. The amount of replenishment is preferably as small as possible. A suitable range is from 20 to 600 ml per square meter of the light-sensitive material, with the range of 30–100 ml being preferred.

In reducing the amount of replenishment, it is preferred to prevent the evaporation and aerial oxidation of processing solutions by reducing the area of contact with the air in processing tanks. The area of contact between the air and the processing solution in a processing tank can be expressed by the "degree of opening" as defined below:

Degree of opening = the area of contact between air and the processing solution ($cm^2$)/the capacity of processing solution ($cm^3$).

The degree of opening as defined above is preferably 0.1 or below, more preferably 0.001–0.05.

The degree of opening as defined above can be reduced by various methods. One method is to provide a shield such as a floating lid on the surface of photographic processing solutions in processing tanks. Other methods include the use of a movable lid as described in JP-A-Hei-1-82033, and processing by slit development as described in JP-A-63-216050.

Reduction in the degree of opening is preferably applied not only in a color developing or a black-and-white developing step but also in all subsequent steps such as, for example, bleaching, bleach-fixing, fixing, washing with water and stabilization.

The amount of replenishment can be reduced by adopting a means of suppressing the accumulation of bromide ions in the developing solution.

The desilvering process that can be applied in the present invention is described below. A desilvering process may generally consist of any steps that are practiced either individually or in combination, as exemplified by the combination of a bleaching step and a fixing step, the combination of a fixing step and a bleach-fixing step, the combination of a bleaching step and a bleach-fixing step, or a bleach-fixing step alone.

Next, the bleaching solution, the bleach-fixing solution and the fixing solution that can be used in the present invention will be described.

Any bleaching agent can be used in the bleaching solution or bleach-fixing solution. Particularly preferred bleaching agents include: organic complex salts of iron (III) (e.g., complex salts with aminopolycarboxylic acids such as ethylenediaminetetracetic acid and diethylenetriaminepentaacetic acid, aminopolyphosphonic acid, phosphonocarboxylic acid and organic phosphonic acid), or organic acids such as citric acid, tartaric acid and malic acid; persulfates; hydrogen peroxide, etc.

Among the compounds listed above, organic complex salts of iron (III) are particularly preferred from the viewpoints of rapid processing and preventing environmental pollution. Examples of aminopolycarboxylic acids, aminopolyphosphonic acid, organic phosphonic acid and salts thereof that are useful in forming organic complex salts of iron (III) include ethylenediaminetetraacetic acid, diethylenetriaminepentaacetic acid, 1,3-diaminopropanetetraacetic acid, propylenediaminetetraacetic acid, nitrilotriacetic acid, cyclobexanediaminetetraacetic acid, methyliminodiacetic acid, iminodiacetic acid, glycoletherdiaminetetraacetic acid, etc. These compounds may be in the form of sodium, potassium, lithium or ammonium salts. Among the compounds listed above, iron (III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred on account of their high bleaching power. These complex salts of ferric ions may per se be used in the form of complex salt or, alternatively, a ferric salt such as ferric sulfate, ferric chloride, ferric nitrate, ammonium ferric sulfate or ferric phosphate may be chelated with an aminopolycarboxylic acid, aminopolyphosphonic acid, phosphonocarboxylic acid or other chelating agents to form a complex of ferric ions in solution. Chelating agents may be used in excess of the amount necessary to form complex salts of ferric ions. Among iron complexes, those with aminopolycarboxylic acids are preferred and they are added in amounts of 0.01–1.0 mole/l, preferably 0.05–0.50 moles/l. The bleaching solution, the bleach-fixing solution and/or prebaths therefor may contain various compounds as bleach accelerators. Preferred examples are the compounds having a mercapto group or disulfide bond described in U.S. Pat. No. 3,898,858, German Patent No. 1,290,812, JP-A-53-95630, and Research Disclosure No. 17129 (July 1978), thiourea compounds as described in JP-B-45-8506, JP-A-52-20832, JP-A-53-32735 and U.S. Pat. No. 3,706,561, and halides containing iodide or bromide ions, and these compounds are preferred for their high bleaching power.

The bleaching solution or bleach-fixing solution that can be used in the present invention may further contain rehalogenating agents such as bromides (e.g. potassium bromide, sodium bromide and ammonium bromide), chlorides (e.g. potassium chloride, sodium chloride and ammonium chloride) and iodides (e.g. ammonium iodide). If desired, those solutions may have added thereto one or more inorganic or organic acids having a pH buffering action, as exemplified by borax, sodium metaborate, acetic acid, sodium acetate, sodium carbonate, potassium carbonate, phosphorous acid, phosphoric acid, sodium phosphate, citric acid, sodium citrate and tartaric acid, alkali metal or ammonium salts thereof, or corrosion inhibitors such as ammonium nitrate and guanidine.

Known fixing agents can be used in the bleach-fixing solution or fixing solution, and they include: thiosulfates such as sodium thiosulfate and ammonium thiosulfate; thiocyanates such as sodium thiocyanate and ammonium thiocyanate; and water-soluble silver halide dissolving agents such as thioether compounds (e.g., ethylenebisthioglycolic acid and 3,6-dithia-1,8-octanediol) and thioureas. These fixing agents may be used either independently or in combination. Also usable are special bleach-fixing solutions that comprise fixing agents in combination with large amounts of halides such as potassium iodide, as described in JP-A-55-155354. The use of thiosulfates, especially ammonium thiosulfates, is preferred in the present invention. Fixing agents are preferably used in amounts of 0.2–2 moles, more preferably 0.3–1.0 mole per liter. The bleach-fixing or fixing solution has a pH that preferably ranges from 3 to 9, more preferably from 4 to 8.

The bleach-fixing solution may also contain various optical brightening agents, antifoaming agents, surfactants, or organic solvents such as polyvinyl pyrrolidone and methanol.

The bleach-fixing solution and fixing solution preferably contain sulfite-ion releasing compounds as preservatives, and they include sulfites (e.g., sodium sulfite, potassium sulfite and ammonium sulfite), bisulfites (e.g., ammonium bisulfite, sodium bisulfite and potassium bisulfite) and metabisulfites (e.g. potassium metabisulfite, sodium metabisulfite and ammonium metabisulfite). These compounds are preferably contained in amounts of about 0.02–1.0 mole/l, more preferably 0.04–0.6 moles/l, as calculated for sulfite ions.

Sulfites are generally added as preservatives, but other compounds may also be added, such as ascorbic acid, carbonyl bisulfite adducts or carbonyl compounds.

Further, buffering agents, optical brightening agents, chelating agents, antifoaming agents, antifungal agents (mold inhibitors), etc. may be added as desired.

After desilvering treatments such as fixing or bleach-fixing, the light-sensitive material is usually subjected to washing with water and/or stabilization.

The volume of water used in the washing step may be set at values carrying over a wide range depending upon the characteristics (as related to couplers and other components) of the light-sensitive material and its use, the temperature of the washing water, the number of steps or washing tanks, and various other factors. Among these factors, the relationship between the number of washing tanks and the volume of water used in a multi-stage countercurrent system can be determined by the method described in Journal of the Society of Motion Picture and Television Engineers, Vol. 64, pp. 248–253, May 1955. The number of states in a multi-stage countercurrent system is generally preferably in the range of 2–6, with the range of 2–5 being particularly preferred.

According to a multi-stage countercurrent system, the volume of washing water that need be used can be reduced markedly, for example, to 500 ml or less per square meter of the light-sensitive material, whereby the advantages of the present invention are attained in a noticeable way. However, if the volume of washing water is reduced, the water will stay within the tank for an increased period, causing such problems as bacterial growth and deposition of the resulting suspended matter on the light-sensitive material. As a solution to these problems, the method described in JP-A-62-288838, which is directed to reducing the amounts of calcium and magnesium, can be used very effectively. Also usable are the isothiazolone compounds and thiabendazole described in JP-A-57-8542, chlorine-containing bactericides such as the chlorinated sodium isocyanurate described in JP-A-61-120145, the benzotriazole described in JP-A-61-267761, cupreous ions, and the bactericides described in "Bokin Bobai no Kagaku (Antibacterial & Antifungal Chemistry)", H. Horiguchi, Sankyo Shuppan (1986), "Biseibutsu no Genkin, Sakkin, Bobai Gijutsu (Microbial Reduction, Sterilization and Antifungal Technology)", ed. by the Committee of Hygienic Technology, Kogyo Gijutsukai (1982), and "Bokin Bobaizai Jiten (Encyclopaedia of Antibacterial and Antifungal Agents)", ed. by the Society of Antibacterial and Antifungal Agents, Japan (1986).

Further, the washing water may incorporate surfactants as water drainers, or chelating agents as water softeners which may be typified by EDTA.

Treatment with a stabilizing solution may follow the washing step described above, or it may immediately follow the desilvering process (i.e., the washing step is skipped). The stabilizing solution contains compounds having a capability for image stabilization, and they include aldehyde compounds typified by formaldehyde, buffering agents for adjusting the pH of the light-sensitive material to a level suitable for dye stabilization, and ammonium compounds. Further, the various bactericides and antifungal agents described above may be used in order to prevent bacterial growth in the solution and to impart antifungal properties to the processed light-sensitive material.

Further, surfactants, optical brightening agents and hardeners may also be added. If stabilization is to be performed immediately without washing with water in the processing of the light-sensitive material, all of the known methods described in JP-A-57-8543, JP-A-58-14834, JP-A-60-220345, etc. may be employed.

In another preferred embodiment, chelating agents such as 1-hydroxyethylidene-1,1-diphosphonic acid and ethylenediaminetetra-methylenephosphonic acid, as well as magnesium and bismuth compounds may be used.

A so-called "rinsing solution" may similarly be used as the washing or stabilizing solution subsequent to the desilvering process.

The preferred pH range for use in the washing or stabilizing step is from 4 to 10, more preferably from 5 to 8. The temperature can be set at various values depending upon such factors as the use and characteristics of the light-sensitive material, and the customary range is from 20° to 50° C., preferably from 25° to 45° C. The washing or stabilizing time can be set at any desired value but a shorter time is desired from the viewpoint of shortening the overall processing time. The preferred range is from 10 to 60 seconds, more preferably from 15 to 45 seconds. The amount of replenishment is preferably small from the viewpoints of such factors as running cost, reduction in the amount of effluents and handling properties.

Stated more specifically, the preferred amount of replenishment is in range of 0.5–50 times, more preferably 3–40 times, the amount of carryover from a preceding bath per unit area of the light-sensitive material. Alternatively, the preferred amount of replenishment is 500 ml or less, more preferably 300 ml or less, per square meter of the light-sensitive material. Replenishment may be performed either continuously or intermittently.

The solution used in the washing and/or stabilizing step may further be used in a preceding step. An example of this approach is such than an overflow of the washing water the amount of which is reduced by adopting a multi-stage countercurrent system is admitted into the preceding bleach-fixing bath which in turn is replenished with a concentrated solution, thereby reducing the amount of waste liquor.

Figure 15:
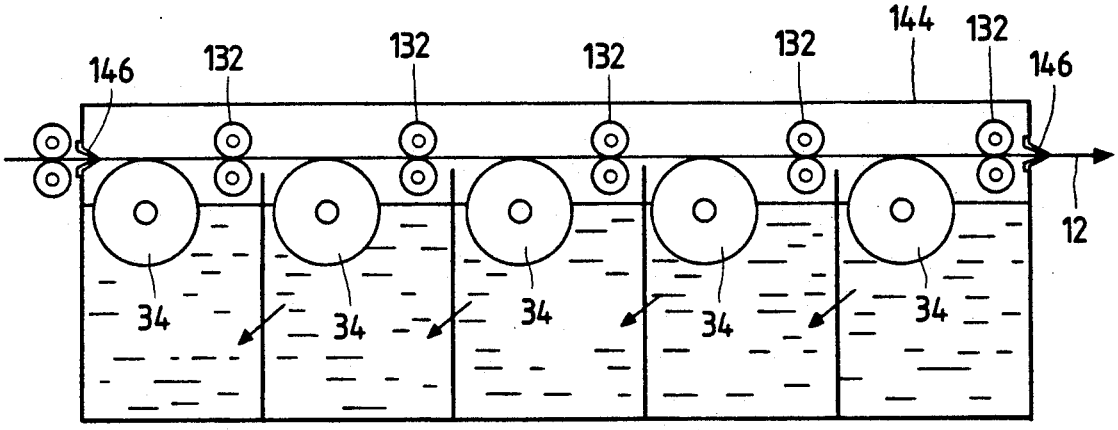
Figure 16:
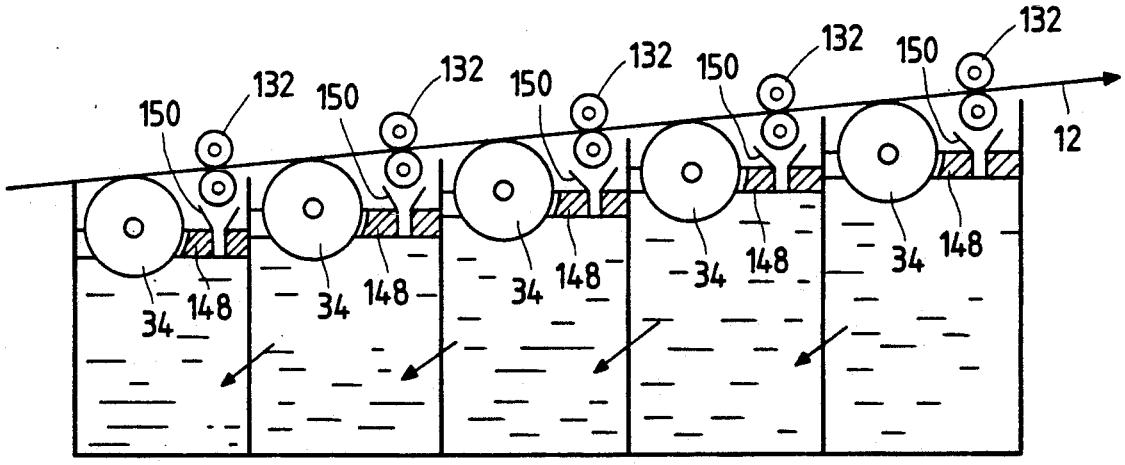

FIGS. **14*a*–14*c*** show in perspective view various specific examples of the pickup roller;

FIG. 15 is a cross section of processing tanks equipped with an airtight lid; and FIG. 16 is a cross section of processing tanks equipped with floating lids.

DESCRIPTION OF THE PREFERRED EMBODIMENTS

Preferred embodiments of the present invention are described below with reference to the accompanying drawings. It should however be noted though that the present invention is by no means limited to those embodiments.

Figure 1:
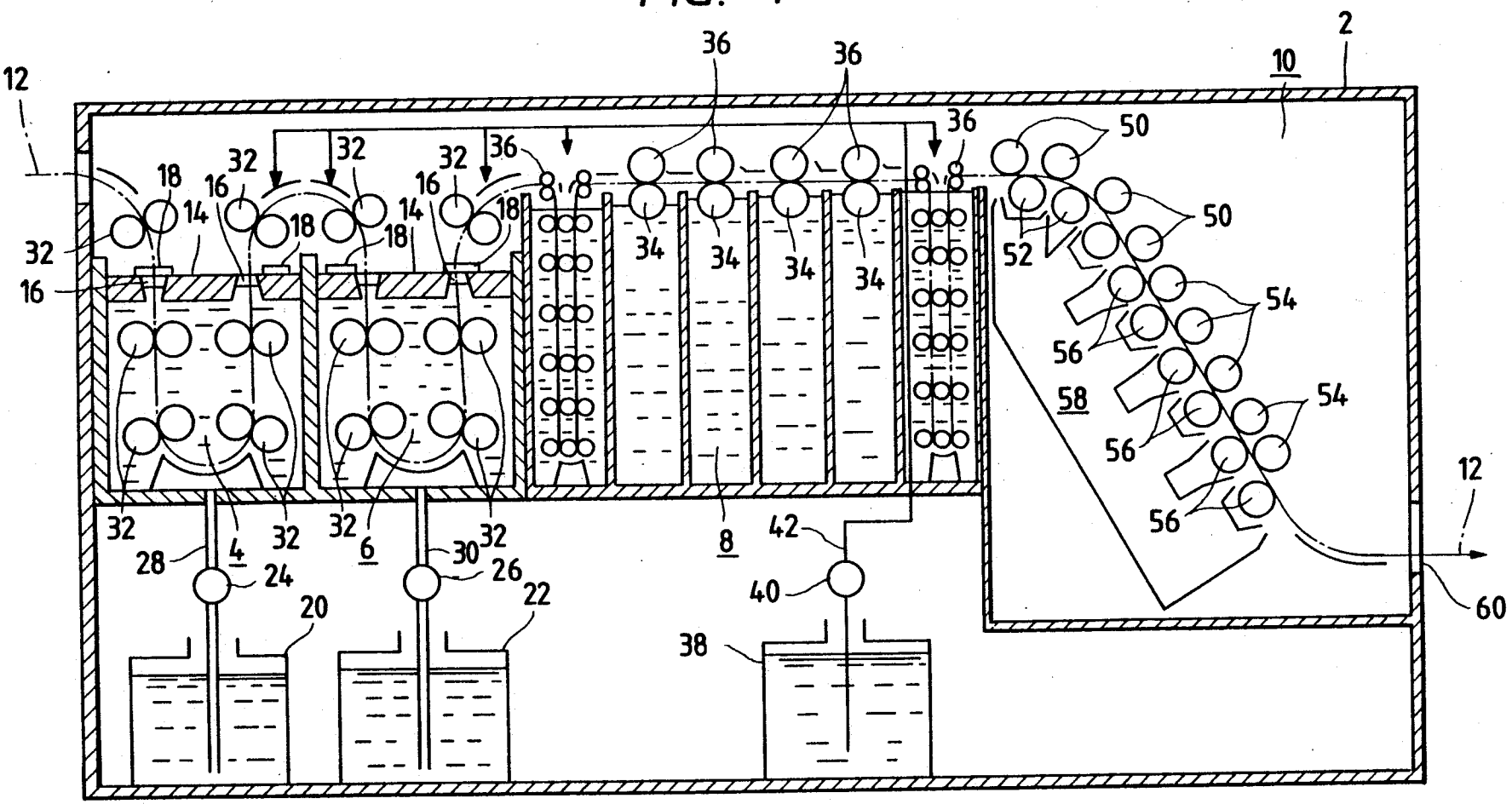
FIG. 1 is a diagram showing schematically the construction of an apparatus for processing a light-sensitive material incorporating an embodiment of the present invention.

FIG. 1 shows a silver halide photographic color paper processor incorporating the apparatus of the present invention. In the processor, webs of color paper that have been exposed on the basis of a positive original are developed, bleach-fixed, washed with water and dried to form an image on the color paper. The color paper that can be processed with this processor (which color paper is hereinafter referred to as "light-sensitive material") is a color photographic material that has on a support at least one layer of silver halide emulsion containing at least 95 mol% silver chloride, and it is color developed with a color developing solution containing an aromatic primary amino color developing agent.

The processor body 2 contains in sequence a developing tank 4, a bleach-fixing tank 6, a washing zone 8 and drying zone 10. The exposed light-sensitive material 12, after being developed, bleach-fixed and washed, is dried in the drying zone 10 and emerges from the body 2.

Each of the developing tank 4 and the bleach-fixing tank 6 is equipped with a floating lid 14 for minimizing the area of contact between the ambient air and the developing solution or bleach-fixing solution in the tanks. Each floating lid 14 has passages 16 through which the light-sensitive material 12 is guided. Those passages are provided with liquid level shutters 18 that close and open the passages. FIG. 1 shows the state in which the entrance passage to the developing tank 4 and the exit passage from the bleach-fixing tank 6 are closed with shutters 18, whereas the exit passage from the developing tank 4 and the entrance passage to the bleach-fixing tank 6 are open.

Provided below the developing tank 4 and the bleach-fixing tank 6 are tanks 20 and 22 for charging the respective tanks with a development replenisher and a bleach-fix replenisher. The replenishers in the tanks 20 and 22 are supplied into the developing tank 4 and the bleach-fixing tank 6 in a controlled manner by means of pumps 24 and 26 via pipes 28 and 30.

Each of the developing tank 4 and the bleach-fixing tank 6 is provided with two pairs of transport rollers 32 which cause the light-sensitive material 12 to be transported through the developing solution or the bleach-fixing solution.

Six washing tanks **8*a*–8*f* provided in the washing zone 8** are cascade-connected in such a way that the cleanliness of the washing water gradually decreases from the last tank to the first tank.

Each of the first tank **8*a* and the last tank 8*f* is provided with transport rollers 36 that transport the light-sensitive material 12 through the washing water in the tank to be supplied onto the emulsion coated surface (the underside as viewed in FIG. 1) of the light-sensitive material 12. Below the washing zone 8 is provided a .tank 38 for replenishing the last washing tank with fresh washing water. The replenishing solution in the tank 38 is supplied into the last tank by means of a pump 40 and a pipe 42. At the same time, the replenishing solution is supplied to the transport rollers 32** for cleaning their peripheral surfaces.

Heating rollers 50 in contact with the support of the light-sensitive material 12 and water-absorbing rollers 52 in contact with the emulsion coated surface of the same material are provided near the entrance to the drying zone 10. Transport rollers 54 and 56 for transporting the light-sensitive material 12 are provided downstream of the water-absorbing rollers 52 and the heating rollers 50. The drying zone 10 is also provided with ducts 58 for supplying hot air between adjacent rollers to be blown against the emulsion-coated surfaces of the light-sensitive material 12.

Figure 2:
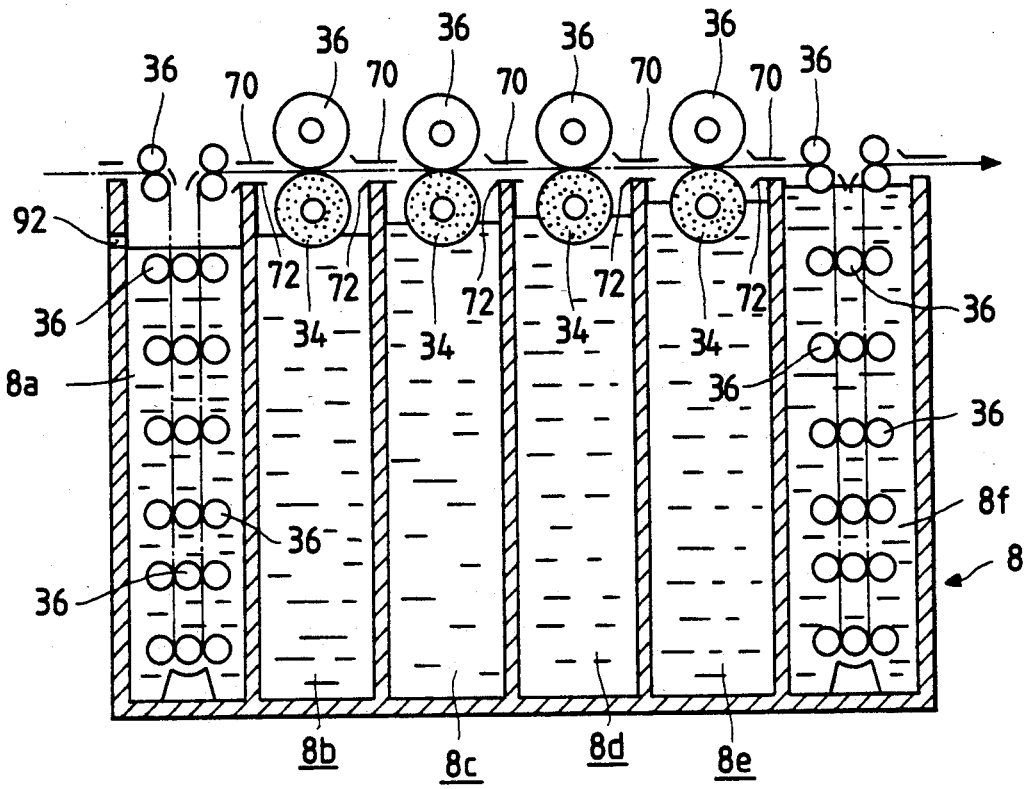
FIG. 2 is a cross section of a zone for washing the light-sensitive material with water.

FIG. 2 is a schematic cross section of the washing zone 8.

Washing tanks **8*a*–8*f* are cascade-connected. A fresh solution for replenishing the washing water is supplied to the last tank 8*f* in a controlled manner. Further, the replenishing water is supplied from the last tank 8*f* to the preceding tank 8*e* and successively supplied in a like manner from the tank 8*e* to preceding tanks. Washing water that overflows the first tank 8*a* through an outlet 92 is recovered into a waste liquor tank or some other suitable container. Hence, the cleanliness of the washing water increases as the light-sensitive material advances in the forward direction. The amount of washing water with which the last tank 8*f* is replenished is preferably 0.5–3 times the volume of the cleaning solution carried the light-sensitive material 12 from the preceding tank 8*e***.

In the first tank **8*a* and the last tank 8*f*, the light-sensitive material 12 is transported through the washing water by means of transport rollers 36, but it is transported horizontally above the intermediate tanks 8*b*–8*e* by means of transport rollers 36. Between adjacent transport rollers 36, the light-sensitive material 12 is guided to pass between upper guide members 70 and lower guide members 72. The pickup rollers 34 are partly submerged in the washing water in such a way that the peripheral surface of each roller is in substantial contact with the light-sensitive material 12. The transport rollers 36 are preferably made of rubber. The pickup rollers 34 are constructed in such a way that they can pick up the washing water by carrying it. Examples of such pickup rollers are a roller having ridges and grooves in the peripheral surface, a Meyer rod, a roller for gravure printing, a sponge roller, etc. If the pickup rollers 34** are rollers having ridges and qrooves in the peripheral surface, it is preferred for practical purposes that the depth of grooves and the height of ridges each be within the range of 0.1–5 mm. If Meyer rods are used as the pickup rollers, the wires preferably have a diameter of 1–5 mm.

The pickup rollers 34 are capable of rotating in the forward direction (i.e., in the direction in which the light-sensitive material is transported) or in the reverse direction by means of a suitable drive unit (not shown).

Figure 3:
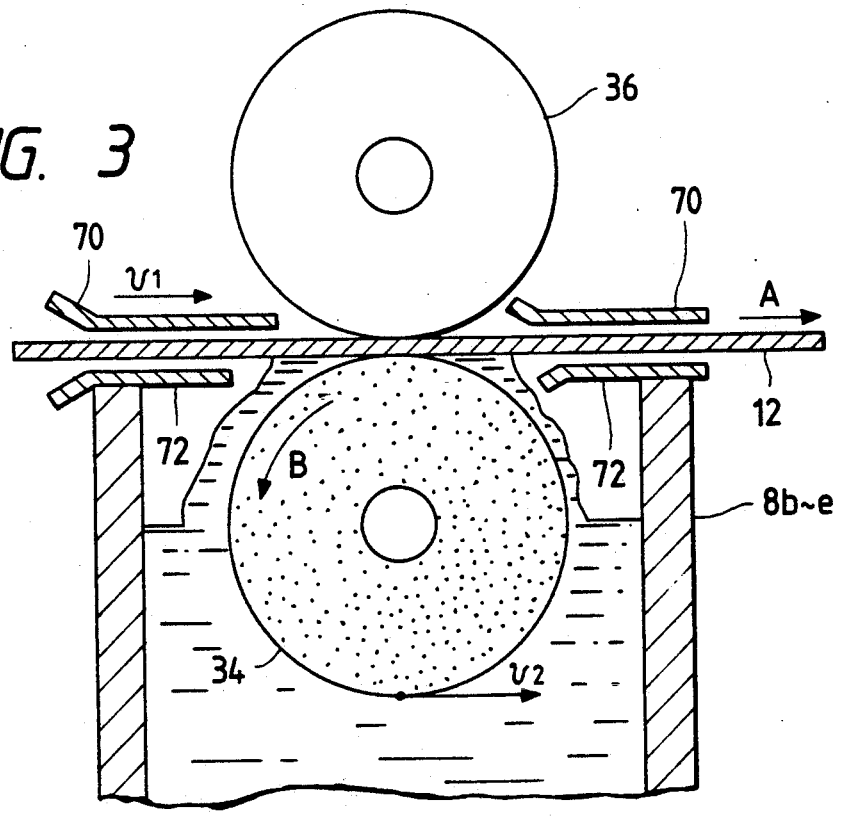
FIG. 3 is an enlarged cross section of the area near a pickup roller.

FIG. 3 is an enlarged cross section of the area near a pick roller.

The light-sensitive material 12 is transported at speed $v_1$ in the direction indicated by arrow A. The pickup roller 34 which is in substantial contact with the emulsion-coated surface of the light-sensitive material 12 carries and picks up washing water by rotating in the reverse direction indicated by arrow B. The peripheral speed $v_2$ of the pickup roller 34 is at least 1.5 times preferably 20–1,000 times, more preferably 30–500 times, and most preferably 60–300 times, the absolute value of the transport speed of the light-sensitive material, $V_1$.

The washing water picked up by the pickup roller 34 is supplied to the light-sensitive material 12. Further, the pickup roller 34, which is in sliding contact with the light-sensitive material 12, scrapes off the components of processing solutions deposited on the surface of the light-sensitive material 12, whereby those components fall into the associated tank together with the washing water. In addition, the components of processing solutions that have been incorporated in the emulsion coating on the light-sensitive material 12 also dissolve out into the washing water by contact with the latter, whereby those components also fall into the tank together with the washing water. As a result, the cleaning procedure can be accomplished in an efficient manner within a short period of time.

The pickup roller 34 preferably remains stationary until the light-sensitive material 12 reaches it. When the light-sensitive material 12 reaches the pickup roller 34, the latter is driven to rotate in the reverse direction, thereby performing the cleaning operation. The pickup roller 34 need not always be rotated in the reverse direction; it may be rotated in the forward direction after reverse rotation for a predetermined period of time. Alternatively, the pickup roller 34 may be rotated in the forward direction starting at the time when the light-sensitive material 12 reaches it. Further, the pickup roller 34 may be rotated in the reverse direction after rotating in the forward direction for a predetermined period of time.

The pressure at which the pickup roller 34 contacts the light-sensitive material 12 is adjusted in such a way that no abrasion marks develop on the surface of the light-sensitive material 12 on account of the sliding contact between the pickup roller 34 and the light-sensitive material 12.

The pickup roller 34 need not be in contact with the light-sensitive material 12. Even if the pickup roller 34 is located at a position slightly apart from the light-sensitive material 12, the roller, once it rotates, picks up the washing water on its peripheral surface and supplies it to the light-sensitive material 12. Even if the pickup roller 34 is spaced from the light-sensitive material 12, the washing water can be supplied to the light-sensitive material 12 as long as liquid puddles are formed between the material and the pickup roller

34. The pickup roller 34 should be partly submerged in the washing water in such a way that it is capable of picking up the washing water, but it should not be completely submerged in the washing water.

In the embodiment under present consideration, the intermediate tanks **8*b*–8*e* in the washing zone 8 are constructed in such a way that only the emulsion-coated surface of the light-sensitive material 12 is cleaned with the washing water. However, in the first tank 8*a* and the last tank 8*f*, the light-sensitive material 12 is cleaned with it being completely immersed in the washing water, which allows not only the emulsion-coated surface but also the support side of the light-sensitive material 12** to be cleaned effectively. The total time required of the washing steps described is preferably within 30 seconds.

As described above, by cascade-connecting a plurality of washing tanks in such a way that the light-sensitive material 12 is transported through the washing water in at least one washing tank, both the emulsion-coated surface and the support side of the light-sensitive material 12 can be effectively cleaned. However, there is no particular need to provide a washing tank of the immersion type for the sole purpose of cleaning the emulsion-coated surface of the light-sensitive material 12.

In the embodiment described above, a plurality of washing tanks **8*b*–8*e*** equipped with pickup roller will prove effective for the purposes of the present invention.

The number of pickup rollers 34 to be provided for the washing tanks **8*b*–8*e* is not limited to one, and a plurality of pickup rollers 34 may be provided in each one of these tanks 8*b*–8*e***.

Figure 4:
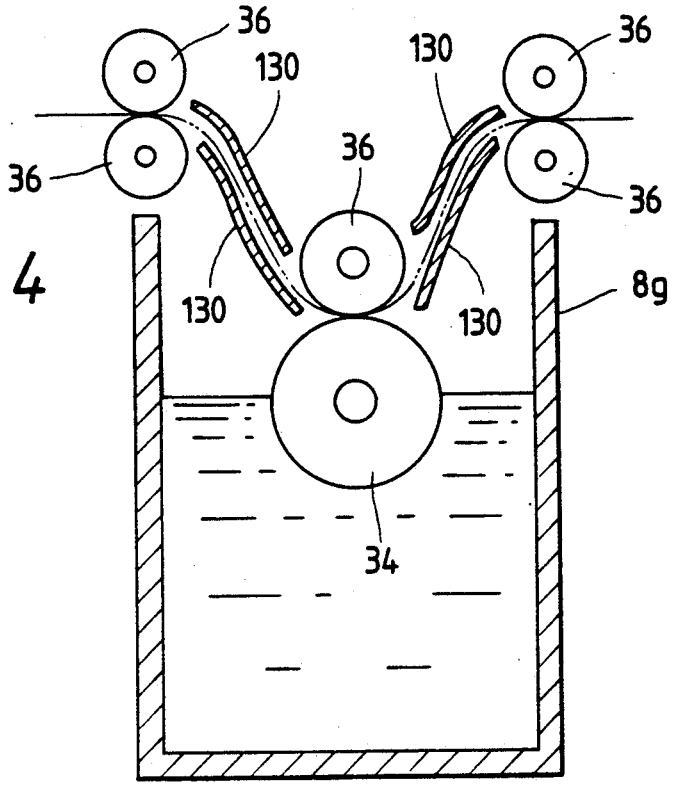
FIG. 4–10 are cross sections showing various modifications of the washing zone.
Figure 5:
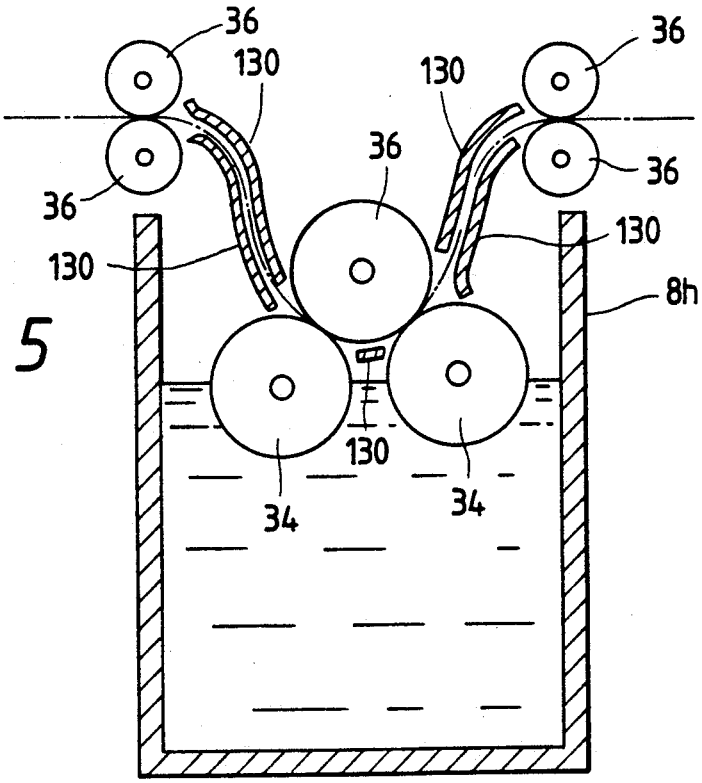

FIGS. 4 and 5 are cross sections showing two modifications of the washing tank.

In the washing tank **8*g* shown in FIG. 4, the light-sensitive material 12 is not transported horizontally but, instead, it is first made to descend toward the surface of the washing water by means of transport rollers 36 and guide members 130, and then caused to ascend by means of guide members 130 and transport rollers 36. The pickup roller 34 is partly submerged in the washing water in such a way that it contacts the light-sensitive material 12 in the lowest position of the transport path where the light-sensitive material 12 being transported downward changes its direction to travel upward. The pickup roller 34 rotates to supply the washing water onto the surface of the light-sensitive material 12**, where it replaces the fouled washing solution, thereby to accomplish efficient washing with water.

Part of the water that has been used to clean the light-sensitive water is transported as it is deposited on the light-sensitive material 12, but such deposited water will flow down when the light-sensitive material 12 is transported upward, thereby preventing the fouled washing water from being carried into the next adjacent tank. The pickup roller 34 may be rotated either in the forward or reverse direction.

In the washing tank **8*h* shown in FIG. 5, the light-sensitive material 12 is also first caused to descend toward the surface of the washing water by means of transport rollers 36 and guide members 130, and then caused to ascend by means of guide members 130 and transport rollers 36. Two pickup rollers 34*a* and 34*b* are partly submerged in the washing water in such a way that they contact the light-sensitive material 12 in the position where the light-sensitive material being transported downward changes it direction to travel upward. The pickup rollers 34*a* and 34*b* may be rotated in either the forward or reverse direction. If the upstream roller 34*a* is rotated in the forward direction while the downstream pickup roller 34*b* is rotated in reverse direction, the washing water that has cleaned the light-sensitive material 12** will flow down toward the lowest position of the transport path, thereby preventing the dirty washing water from being carried into the next adjacent tank.

Various modifications of the processor are described below.

Figure 6:
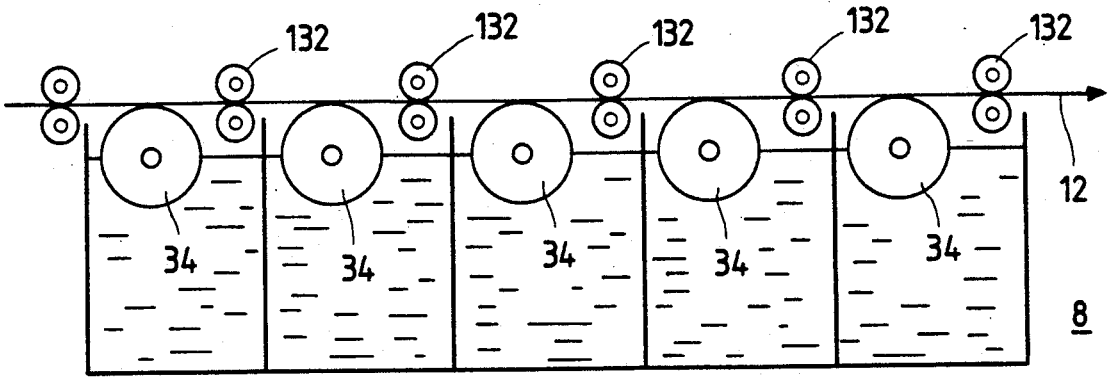

FIG. 6 is a cross section of a first modification of the washing tanks, each of which is equipped with a pickup roller 34 and squeezed rollers 132. In each of the washing tanks, the pickup roller rotates at a speed so much faster than the transport speed of the light-sensitive material that dirty washing water on the surface of the light-sensitive material layer 12 is rapidly replaced by fresh washing water. Further, the washing water deposited on the light-sensitive material 12 is removed by the squeeze rollers 132 to insure that the components of processing solutions that dissolved into the washing water from the light-sensitive material are effectively removed. In addition, the squeeze rollers 132 provided downstream of the pickup roller 34 in the same tank prevent the dirty washing water from getting into subsequent tanks.

Figure 7:
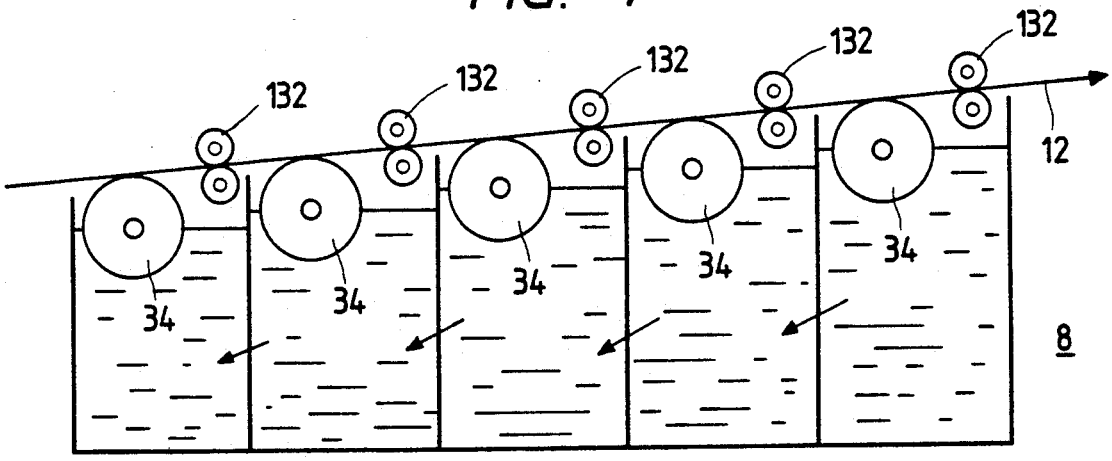

FIG. 7 is a cross section showing a second modification of the washing tanks. This modification is similar in construction to the case shown in FIG. 6, but differs in that the washing tanks are cascade-connected. Each of the washing tanks shown in FIG. 7 is provided with a pickup roller 34 and squeeze rollers 132 in such a way that the washing water is picked up by the roller 34 to be supplied to the light-sensitive material 12 and thereafter removed from the latter by means of squeeze rollers 132. The last tank is replenished with fresh washing water and an overflow from a tank at a later stage is supplied successively into tanks at preceding stages. Hence, the cleanliness of the washing water increases toward tanks at later stages. In order to insure that the washing water will easily overflow in the backward direction (from a tank at a later stage to tanks at preceding stages), the liquid level in the tanks in preceding stages, whereby the light-sensitive material 12 is transported ascending at a slight slope.

Figure 8:
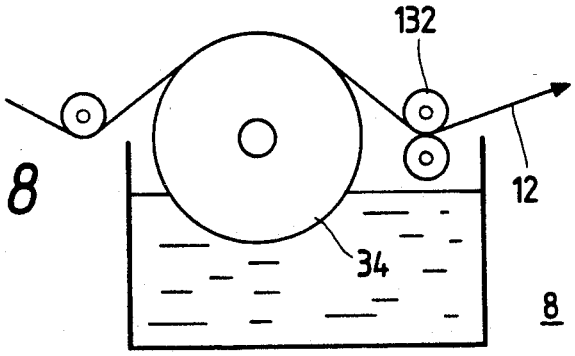

FIG. 8 is a cross section showing a third modification of the washing tanks, in which the light-sensitive material 12 is transported along an arched path along the periphery of the pickup roller 34. The greater the angle through which the light-sensitive material 12 is wound onto the pickup roller 34, the larger the amount of processing solution that can be held between the light-sensitive material 12 and the pickup roller 34, thereby achieving rapid and efficient processing of the light-sensitive material 12. The washing water supplied to the light-sensitive material 12 is removed by squeeze rollers 132 in the same manner as already described above.

Figure 9:
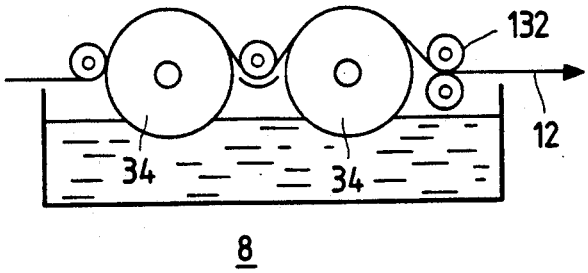

FIG. 9 is a cross section showing a fourth modification of the washing tanks. As shown, two pickup rollers 34 are provided downstream of the pickup roller 34 positioned downstream in the direction of transport of the light-sensitive material.

Figure 10:
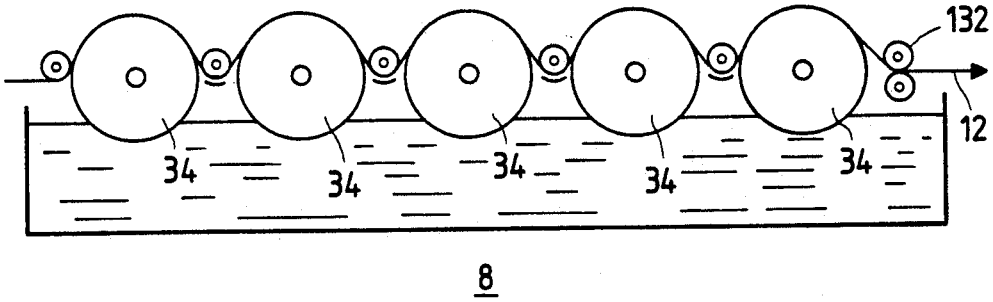

FIG. 10 is a cross section showing a fifth modification of the washing tanks, in which multiple pickup rollers 34 are connected in series in a washing tank. Squeeze rollers 132 are provided downstream of the pickup roller 34 the farthest downstream of the transport of the light-sensitive material.

The five modifications described above relate to the washing tanks, but it should be understood that they are also applicable to other processing tanks such as the developing tank and the bleach-fixing tank.

Figure 11:
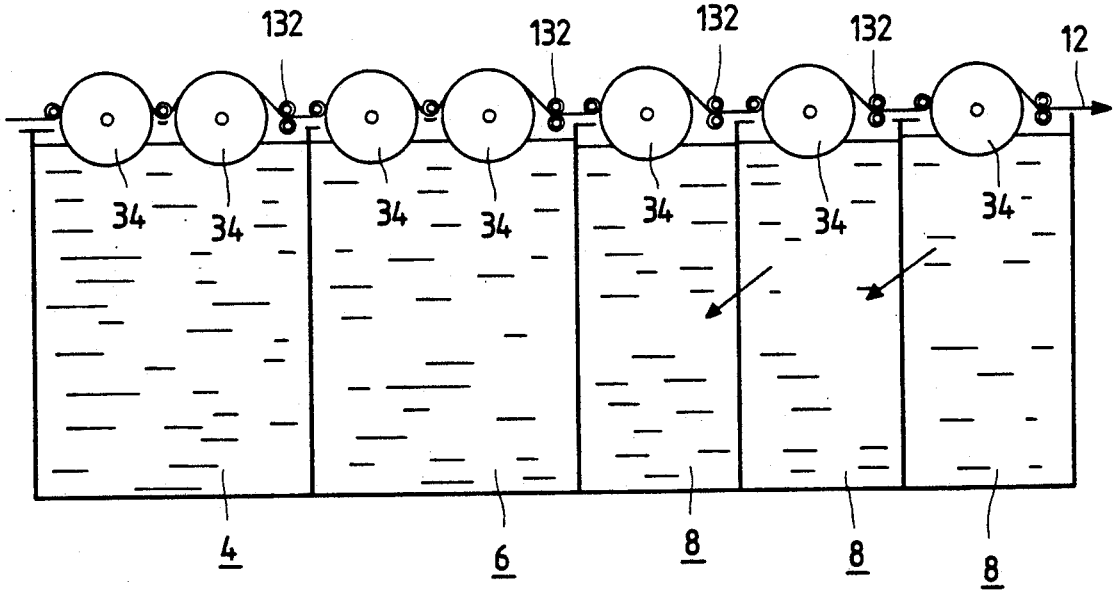
FIG. 11–13 are cross sections showing various modifications of the processor.

FIG. 11 is a cross section showing a modification of the processor taken as a whole, in which each of the developing tank 4, the bleach-fixing tank 6 and the washing tanks 8 is provided with pickup rollers 34 and squeeze rollers 132. Two pickup rollers 34 are provided within each of the developing tank 4 and the bleach-fixing tank 6.

Figure 12:
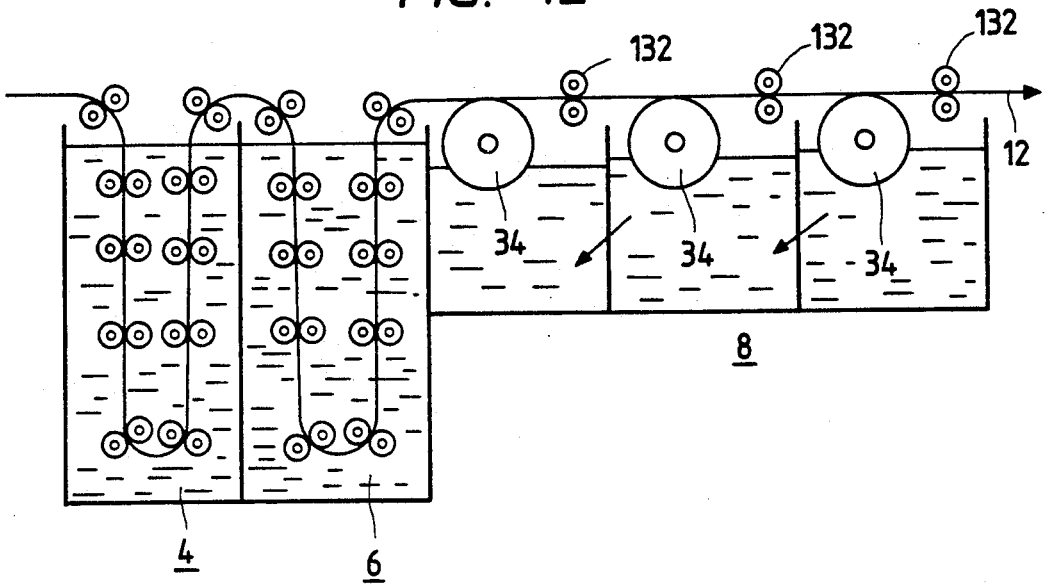

FIG. 12 is a cross section showing another modification of the processor. This modification is similar in construction to the case shown in FIG. 1, but the washing tanks 8 have a different depth than the developing tank 4 and the bleach-fixing tank 6, and the step of immersing the light-sensitive material in the washing tanks is omitted. What is done in the washing tanks 8 is no more than supplying washing water to the light-sensitive material by means of pickup rollers 34, but this is sufficient to clean the light-sensitive material 12 in a satisfactory manner.

Figure 13:
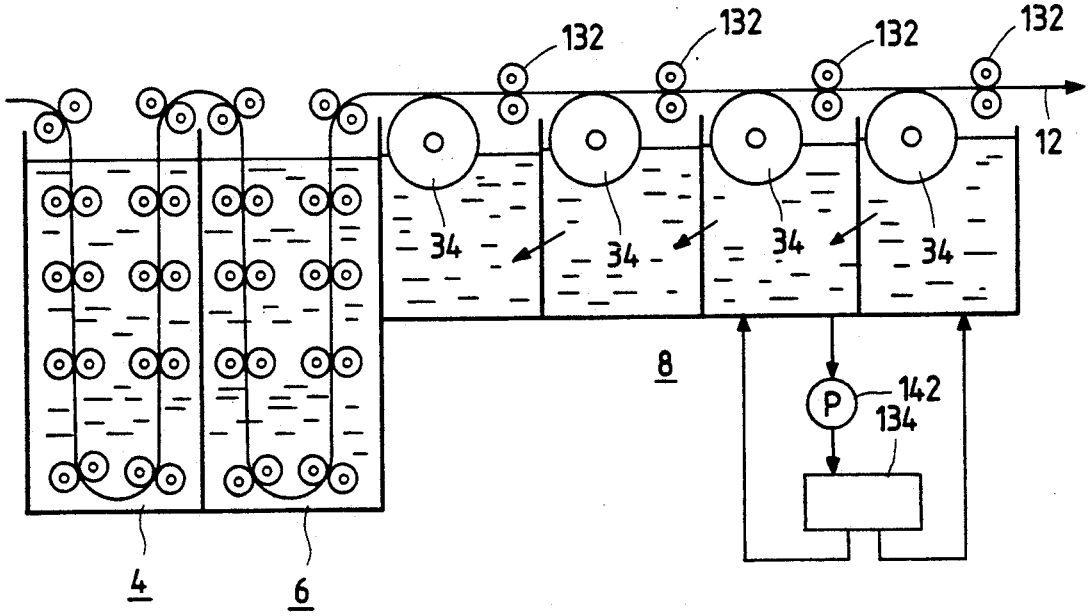
Figure 14A:
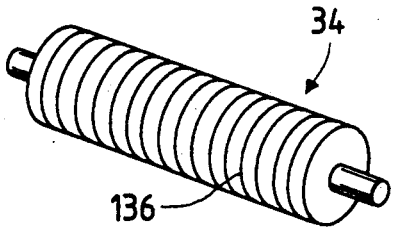
Figure 14B:
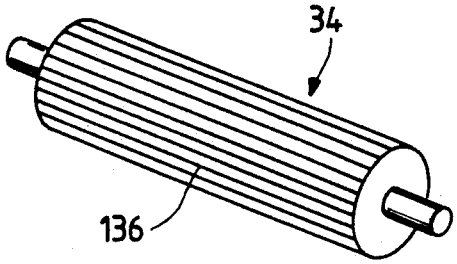
Figure 14C:
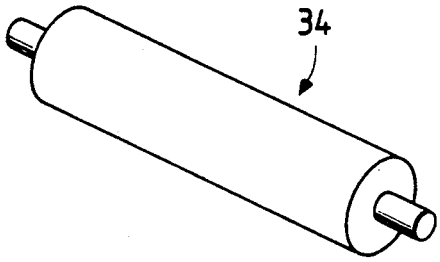
Figure 14D:
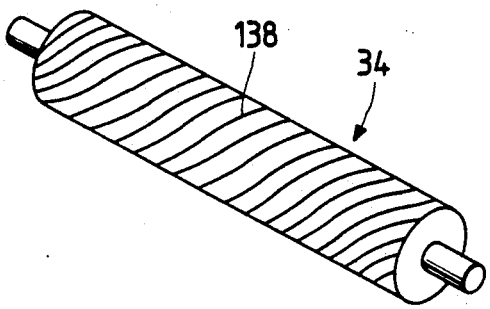
Figure 14E:
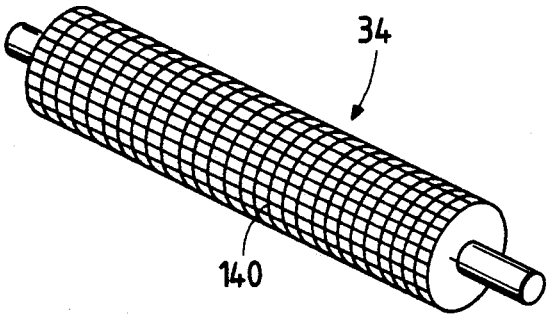

FIG. 13 is a cross section showing still another modification of the processor, which is similar to the construction shown in FIG. 12. In this modification, four washing tanks are provided, and a reverse osmotic membrane 134 is also provided for one of the washing tanks 8. By subjecting the washing water to reverse osmosis through the membrane 134, the unwanted components of the washing water (especially the fixing and bleach-fixing components) are sufficiently removed to reduce their possible adverse effects on the light-sensitive material. The water in the third washing tank is forced into the reverse osmotic membrane 134 by means of a pump 142, and the permeate from the membrane 134 is supplied into the fourth washing tank while the concentrated water which has not passed through the membrane 134 is returned to the third washing tank.

The squeeze rollers 132 employed in the modifications described above may be replaced by squeezed blades or some other suitable means, and the means of removing processing solutions supplied to the light-sensitive material 12 is in no way limited to any particular construction.

FIGS. 14(*a*)–14(*e*) shows various specific forms of the pickup roller 34. FIG. 14(*a*) is a perspective view of a pickup roller 34 having grooves formed in its peripheral surface in the circumferential direction. Instead of cutting grooves 136, a wire may be wound around the pickup roller 34 to form grooves between adjacent turns of the wire. FIG. 14(*b*) is a perspective view of a pickup roller 34 having grooves 136 formed in its peripheral surface in the axial direction. FIG. 14(*c*) is a perspective view of a pickup roller 34 having a flat peripheral surface. FIG. 14(*d*) is a perspective view having spiral grooves 138 in its peripheral surface. FIG. 14(*e*) is a perspective view of a pickup roller 34, which is a roller for gravure printing, having triangular, square, rectangular or otherwise shaped ridges and grooves 140 in its peripheral surface.

While various embodiments of the present invention have been described above with particular reference to the case where the invention is applied to the treatment of washing light-sensitive materials with water, it should be understood that the concept of the present invention is also applicable to other steps of photographic processing, namely, development, bleaching, bleach-fixing, fixing and stabilization. According to the present invention, a pickup roller is partly submerged in one or more processing solutions and rotated to have the processing solution supplied efficiently onto the light-sensitive material which can accordingly be processed in a rapid and efficient manner.

If desired, the space above processing solutions may be rendered airtight in the apparatus of the present invention and, methods for achieving this are described below.

FIG. 15 is a cross section of the case where an airtight lid is provided on top of processing tanks. As shown, an airtight lid 144 is provided above the processing tanks, and the light-sensitive material 12 is supplied with a processing solution as it is transported through a substantially airtight space. The airtight lid 144 is required to provide not only airtightness but also a passageway for the transport of the light-sensitive material 12, and hence a shutter arrangement may be provided in such a way that a slit is closed or opened by means of a pair of flexible blades 146 that contact each other at their free ends. The construction of the shutter arrangement is no way limited to the manner shown in FIG. 15, and another type of shutter as described in JP-A-Hei-2-161431 may be employed. In any event, the space above the processing solution is rendered substantially airtight, whereby the evaporation or oxidation of the processing solution will not proceed so rapidly as to cause its deterioration.

FIG. 16 is a cross section showing the case where a floating lid is provided in processing tanks. The floating lid shown by 148 is of such a shape as to cover substantially all the surface of a processing solution except where the pickup roller 34 is partly submerged. The floating lid 148 is provided with a funnel-shaped device 150 through which the processing solution scraped off by means of the squeeze rollers 132 is recovered into the associated processing tank. The floating lid 148 prevents the processing solution from contacting the air, whereby the evaporation or oxidation of the processing solution will not proceed so rapidly as to cause its deterioration.

EXAMPLES

The following examples are provided for the purpose of further illustrating the present invention, but are in no way to be taken as limiting.

EXAMPLE 1

Color papers ("Fuji Color Paper Super FA-II" produced by Fuji Photo Film Co., Ltd.) were used as samples of light-sensitive material.

Using a sensitometer (Type FWH produced by Fuji Photo Film Co., Ltd.; color temperature of the light source, 3,200° K.), the samples were given multi-level exposure through a sensitometer color separating filter. The exposure was continued for 0.1 seconds to provide 250 OMS.

The exposed samples were color-developed, bleach-fixed and washed with water by the processing scheme set forth below using a processor constructed as shown in FIG. 11. The peripheral speed of the pickup rollers in the processor was 100 times the absolute value of the transport speed of the light-sensitive material, the rollers 16 were rotated in the opposite direction to the transport of the light-sensitive material.

| Steps | Temperature | Time | Replenisher | Tank Capacity |
|---|---|---|---|---|
| Color development | 42° C. | 20 sec | 80 ml | 0.7 l |
| Bleach-fixing | 40° C. | 20 sec | 60 ml | 0.7 l |
| Rising (1) | 45° C. | 10 sec | — | 0.5 l |
| Rising (2) | 45° C. | 10 sec | — | 0.5 l |
| Rising (3) | 45° C. | 10 sec | 90 ml | 0.5 l |
| Drying | 70–80° C. | 15 sec | — | — |

The amounts of replenishers are calculated per square meter of the light-sensitive material.

Rinsing was performed by a three-tank countercurrent method in which the solution for rinsing in step (3) was allowed to flow back successively to rinsing steps (2) and (1).

The individual processing solutions had the following compositions:

| Color Developing Solution | Tank Solution | Replenisher |
|---|---|---|
| Water | 800 ml | 800 ml |

-continued

| Color Developing Solution | Tank Solution | Replenisher |
|---|---|---|
| 1-hydroxyethylidene-1,1-diphosphonic acid | 0.5 g | 0.7 g |
| Diethylenetriaminepentaacetic acid | 1.0 g | 1.4 g |
| N,N,N-trismethylenephosphonic acid | 1.5 g | 2.0 g |
| Potassium bromide | 0.01 g | — |
| Triethanolamine | 8.1 g | 8.1 g |
| Sodium sulfite | 0.14 g | 0.14 g |
| Potassium chloride | 8.2 g | — |
| Potassium carbonate | 18.7 g | 37 g |
| N-Ethyl-N-(3-hydroxypropyl)-3-methyl-4-aminoaniline diparatoluenesulfonic acid salt | 12.8 g | 27.8 g |
| N,N-Bis(2-sulfoethyl)hydroxylamine | 8.5 g | 11.0 g |
| Optical brightening agent ("WHITEX 4B" of Sumitomo Chemical Co., Ltd.) | 1.0 g | 1.0 g |
| Water | to make 1,000 ml | to make 1,000 ml |
| pH (at 25° C.) | 10.05 | 10.95 |

| Bleach-fixing solution | Tank Solution | Replenisher |
|---|---|---|
| Water | 400 ml | 400 ml |
| Ammonium thiosulfate (70% sol.) | 100 ml | 250 ml |
| Ammonium sulfite | 40 g | 100 g |
| Ethylenediaminetetraacetic acid iron (III) ammonium dihydrate | 73 g | 183 g |
| Ethylenediaminetetraacetic acid | 3.4 g | 8.5 g |
| Ammonium bromide | 20 g | 50 g |
| Nitric acid (67% sol.) | 9.6 g | 24 g |
| Water | to make 1,000 ml | to make 1,000 ml |
| pH (at 25° C.) | 5.80 | 5.10 |

Rinsing solution (same for both the tank solution and the replenisher)

Ion-exchanged water (Ca, Na≦3 ppm)

Using Mini-Lab FA (product of Fuji Photo Film Co., Ltd.), processing was done with CP 40FA (development and bleach-fixing times, 45 sec; washing time, 90 sec; product of Fuji Photo Film Co., Ltd.) and a sample prepared by this standard processing was used as a comparison.

The image on the samples that were processed rapidly using the apparatus of the present invention was practically complete and had the same quality as the comparison. The processed samples were left at 80° C. for 7 days at 70% r.h., but the level of staining was in no way different from the comparison subjected to standard processing with Mini-Lab FA. It was therefore clear that the light-sensitive material was cleaned satisfactorily using the apparatus of the present invention.

EXAMPLE 2

The procedure of Example 1 was repeated except for the following changes: The processor used was constructed as shown in FIG. 12. The comparison was a sample that was subjected to standard processing with Mini-Lab FA (product of Fuji Photo Film Co., Ltd.) using its washing zone (total of washing times in three tanks was 90 seconds).

The samples processed with the apparatus of the present invention were in no way different from the comparison in terms of either the whiteness of the background of the image or the increase in staining that occurred when the processed samples with complete image were left at 80° C. and at 70% r.h. In other words, the samples processed in accordance with the present invention achieved commercially acceptable levels in performance.

EXAMPLE 3

A processor constructed as shown in FIG. 13 was used. The procedure of Example 2 was repeated except for the following changes:

Rinsing step (4) was added, and rinsing was performed by a four-tank countercurrent method in which the solution for rinsing in step (4) was allowed to flow back successively to rinsing steps (3), (2) and (1). The staying time in each rinse tank was adjusted to 5 seconds. The replenisher was supplied for the rinsing step (4) rather than step (3). As a reverse osmotic membrane, a spiral RO module element DRA-80 of Daicel Chemical Industries, Ltd. (polysulfone-based composite membrane having an effective membrane area of 1.1 mz) was used and it was installed in a plastic vessel Model PV-0321 of Daicel Chemical Industries, Ltd.

In operating the reverse osmotic membrane system shown in FIG. 13, the water in the third rinse tank was pumped to the reverse osmotic membrane at a pressure of 7 kg/cm$^2$ and at a flow rate of 1.5 l/min, and the permeate was supplied into the fourth rinse tank, whereas the concentrated water was returned to the third rinse tank.

As a comparison, processing was done as in Example 1 using the same apparatus as shown in FIG. 13, except for the washing step which was performed by immersing the light-sensitive material in washing water in four tanks, with the total washing time being 20 seconds (5 seconds for each tank).

The yellow density of the white background of each of the images produced in the processed samples is shown below:

| Sample | Yellow Density of White Background |
|---|---|
| Example 3 | 0.11 |
| Comparison | 0.15 |

This data shows that the apparatus of the present invention achieved more efficient cleaning than the comparison.

In accordance with the present invention, a processing solution is supplied to the surface of a light-sensitive material by means of a pickup roller that is capable of carrying the processing solution and said pickup roller is rotated at a faster peripheral speed than the transport speed of the light sensitive material. As a result, the processing solution is rapidly replaced by a fresh solution on the surface of the light-sensitive material, thus enabling efficient performance of the intended processing. Further, efficient processing can be accomplished with a small amount of the processing solution. In addition, the use of a smaller number of machine components contributes to the construction of a simple and compact apparatus which features easy maintenance.

What is claimed is:

1. In an apparatus for processing a light-sensitive material that has a roller that is partly submerged in a processing solution and that picks up said processing solution to supply said processing solution onto the light-sensitive material being transported above said processing solution, the improvement wherein said roller is rotated at a peripheral speed at least 1.5 times the absolute value of the transport speed of said light-sensitive material.

2. The apparatus of claim 1, wherein said processing solution is a cleaning solution.

3. The apparatus of claim 1, wherein the absolute value of the rotational speed of said roller is at least 60 times the absolute value of the transport speed of said light sensitive material.

4. The apparatus of claim 1, wherein the absolute value of the rotational speed of said roller is in a range of 20 to 1000 times the absolute value of the transport speed of said light sensitive material.

5. The apparatus of claim 1, wherein the absolute value of the rotational speed of said roller is in a range of 30 to 500 times the absolute value of the transport speed of said light sensitive material.

6. The apparatus of claim 1, wherein the absolute value of the rotational speed of said roller is in a range of 60 to 300 times the absolute value of the transport speed of said light sensitive material.

7. The apparatus of claim 1, wherein a space above said processing solution is substantially airtight.

8. The apparatus of claim 7, wherein said space is filled with an inert gas.

9. The apparatus of any one of claims 1 to 8, wherein said roller is rotated in a direction opposite to a transportation direction of said light-sensitive material.

10. The apparatus of claim 1, wherein said roller has grooves and ridges on a peripheral surface thereof.

11. The apparatus of claim 10, wherein a depth of said grooves and ridges is in a range of 0.1 to 5 mm.

12. The apparatus of claim 1, wherein said roller is a water-absorbing roller.

13. The apparatus of claim 1, wherein said roller has a wire wound on an outer surface thereof.

14. The apparatus of claim 13, wherein said wire has a diameter in a range of 1 to 5 mm.

15. The apparatus of claim 1, wherein said roller is a roller for gravure printing.

16. The apparatus of claim 1, wherein said roller is a flat-faced roller.

17. The apparatus of claim 1, wherein said roller is a sponge roller.

18. The apparatus of claim 1, wherein said roller is provided with blades for picking up said processing solution.

19. The apparatus of claim 1, wherein said roller is rotated in the forward direction with respect to a transportation direction of said light-sensitive material after being rotated in a reverse direction for a predetermined time.

20. The apparatus of claim 1, wherein said roller is rotated in the reverse direction with respect to a transportation direction of said light-sensitive material after being rotated in a forward direction for a predetermined time.

21. In an apparatus for processing a light-sensitive material by passing said light-sensitive material through a plurality of successively arranged tanks containing processing solution, the improvement wherein at least one of said tanks has a roller that is partly submerged in the processing solution contained in said tank and that picks up said processing solution to supply said processing solution onto the light-sensitive material being transported above said tank, said roller being rotated at a peripheral speed at least 1.5 times the absolute value of the transport speed of said light-sensitive material.

22. The apparatus of claim 21, wherein one of said rollers is provided in a plurality of said tanks.

23. The apparatus of claim 22, wherein a liquid level in a later tank is higher than a liquid level in a preceding tank.

24. In an apparatus for processing a light-sensitive material by passing said light-sensitive material through a tank containing processing solution, the improvement wherein said tank is provided with a pair of rollers that are partly submerged in the processing solution contained in said tank and that pick up said processing solution to supply said processing solution onto the light-sensitive material being transported above said tank, said rollers being rotated at a peripheral speed at least 1.5 times the absolute value of the transport speed of said light-sensitive material.

25. The apparatus of claim 24, wherein an upstream one of said rollers is rotated in a forward direction with respect to the direction of transportation of said light-sensitive material through said tank and the other of said rollers being rotated in a reverse direction with respect to said direction of transportation.

* * * * *